US005587545A

United States Patent [19]

Nakada et al.

[11] Patent Number: 5,587,545

[45] Date of Patent: Dec. 24, 1996

[54] MUSICAL TOY WITH SOUND PRODUCING BODY

[75] Inventors: Takashi Nakada; Keiichi Kazami, both of Saitama; Kenji Kaneko, Chiba, all of Japan

[73] Assignee: Kabushiki Kaisha B-AI, Japan

[21] Appl. No.: 389,351

[22] Filed: Feb. 16, 1995

[30] Foreign Application Priority Data

| | | | |
|---|---|---|---|
| Mar. 10, 1994 | [JP] | Japan | 6-067681 |
| Sep. 20, 1994 | [JP] | Japan | 6-251366 |
| Nov. 14, 1994 | [JP] | Japan | 6-304403 |

[51] Int. Cl.[6] ..... A63H 3/28; A63H 33/26; G10D 13/08; G10H 1/40

[52] U.S. Cl. ..... 84/600; 84/713; 84/102; 84/405; 84/DIG. 12; 446/133; 446/175; 446/298

[58] Field of Search ..... 84/600, 611, 612, 84/644, 635, 636, 651, 652, 667, 668, 713, 714, 670, 718, DIG. 12, 102–105, 107, 402–410; 446/132–136, 175, 298

[56] References Cited

U.S. PATENT DOCUMENTS

| | | | |
|---|---|---|---|
| 4,889,027 | 12/1989 | Yokoi | 84/DIG. 12 |
| 5,270,480 | 12/1993 | Hikawa | 446/298 X |
| 5,446,236 | 8/1995 | Nakada et al. | 446/298 X |

*Primary Examiner*—Stanley J. Witkowski
*Attorney, Agent, or Firm*—R. Gale Rhodes, Jr.

[57] ABSTRACT

A musical toy in which tappers on the ends of swinging bodies can be swung up and kept upswung without using any springs; space for spring mounting is thereby made unnecessary and the toy can be made small; the manufacturing process can be simplified and resulting mass production benefits and cost reductions can be achieved, and which can operate stably over a long period of time. There are provided a toy body 7, a sound producing body 5 and a control device 54, and the toy body 7 comprises first permanent magnets 23*a* and 23*b* and swinging bodies 9*a* and 9*b* mounted in the vicinity of the first permanent magnets 23*a* and 23*b*. The swinging bodies 9*a* and 9*b* comprise tappers 11*a* and 11*b* for striking the sound producing body 5 and acting parts for magnetically interacting with the first permanent magnets 23*a* and 23*b* and generating a swinging force; the acting part comprises second permanent magnets 31*a* and 31*b* for swinging the tappers up and coils 29*a* and 29*b* for swinging down the upswung tappers against the resistance of the second permanent magnets 31*a* and 31*b*. The control device 54 comprises rhythm signal generating means 57 for generating a rhythm signal and by supplying this rhythm signal to the coils 29*a* and 29*b* causes the swinging bodies 9*a* and 9*b* to swing according to the rhythm signal so that the tappers 11*a* and 11*b* strike the sound producing bodies 5.

8 Claims, 22 Drawing Sheets

FIG. 14
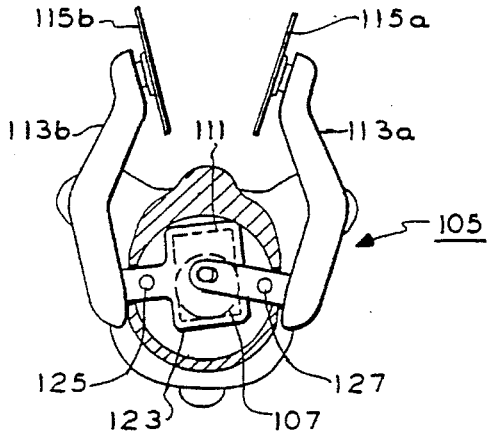
FIG. 15
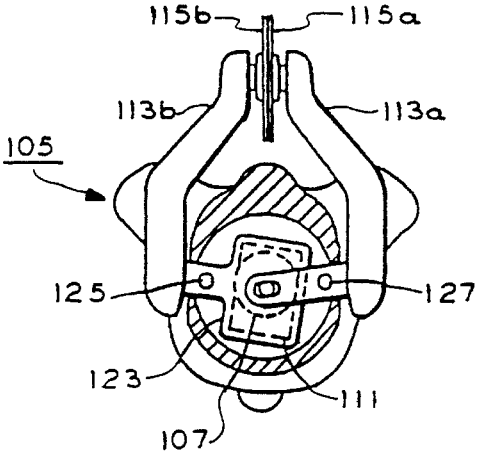
FIG. 18
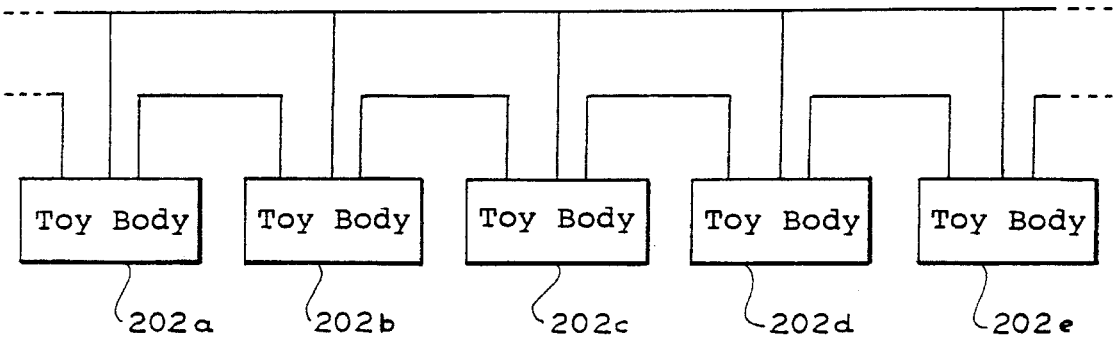
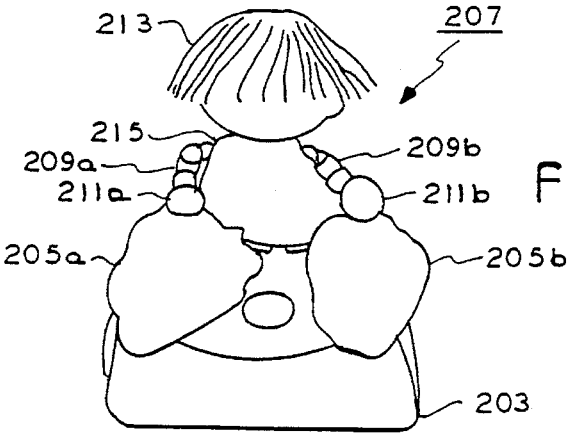
FIG. 19

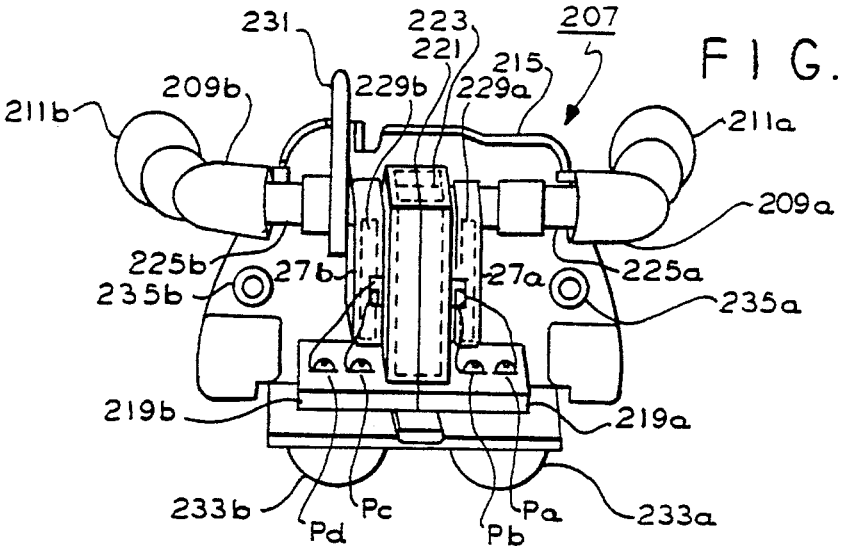
FIG. 20
FIG. 22
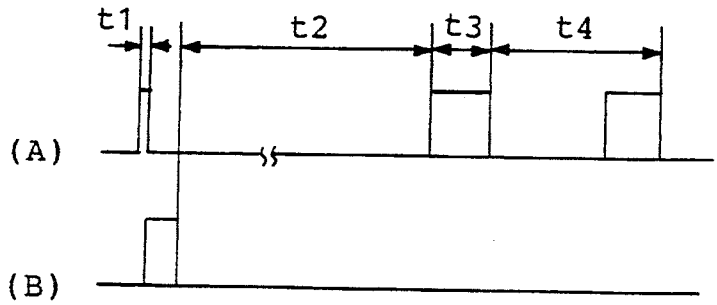
FIG. 23
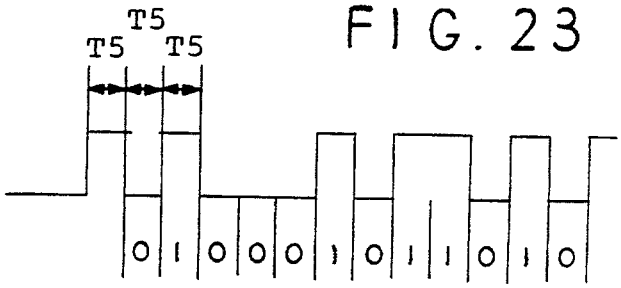
FIG. 24
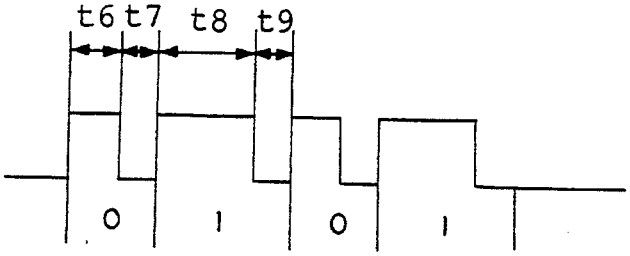

MUSICAL TOY WITH SOUND PRODUCING BODY

BACKGROUND OF THE INVENTION

This invention relates to a musical toy in which a sound producing body is struck by a swinging body caused to swing by a magnetic interaction between a coil and a permanent magnet.

DESCRIPTION OF THE PRIOR ART

In recent years various toys which make sounds have been proposed. In Japanese Laid-Open Utility Model Publication No. S.57-84998, a toy monkey holding a cymbal in each hand is described. This toy is shaped like a monkey and has a built-in microphone, a motor, and a drive transmission mechanism which transmits the rotary drive of the motor. When the microphone detects sounds from outside the toy, a starting signal is outputted, the rotary drive of the motor is transmitted by the transmission mechanism to the left and right arms of the monkey, and the cymbals held in the monkey's hands are struck against each other. Thus the toy will respond to a sound such as a human voice or a hand clap by making a noise by striking the cymbals together. By design the toy stops operating a predetermined fixed time from when it inputs the sound of its own cymbals.

However, conventional musical toys of this kind have not produced sounds with any specific tempo or rhythm, but rather have just made a noise by striking the cymbals together, and the resulting sound has been monotonous. As a result there has been the problem that the listener soon becomes bored of the toy.

Also, because conventional musical toys having a motor comprise a drive transmission mechanism for transmitting the rotary drive of the motor and produce sounds by mechanically transmitting the rotary drive of the motor, they have had the shortcoming that for a toy to be able to produce delicate rhythms it has had to have a complex drive mechanism and the assembly process has consequently been long and complicated.

Furthermore, when gears and cams and the like are used in a drive transmission mechanism for transmitting the rotary drive of the motor, mechanical drive noises are produced. Not only can these mechanical drive noises be grating and uncomfortable to listen to, especially when the toy is heard in a quiet place, they also make it difficult for the toy to faithfully produce subtle rhythm sounds.

Because of this, a musical toy has been being sought which does not make grating mechanical drive noises and has a simple constitution enabling simplification of the assembly process and which can be made to produce specific tempo and rhythm sounds and produce delicate rhythm sounds accurately and faithfully.

In this connection, the present inventors have proposed a musical toy wherein magnetic interactions between coils and permanent magnets are used to cause movable bodies to swing so that tappers on the ends of the movable bodies are swung downward and strike a sound producing body (Japanese Laid-Open Patent Publication No. H.6-304341).

FIG. 33 is an exterior perspective view of a toy body 401 and peripherals thereof used in the conventional musical toy referred to above, and FIG. 34 is an exploded perspective view of this toy body 401.

A case 403 is disposed in a central portion of the toy body 401, and a pair of permanent magnets 405*a* and 405*b* are mounted inside the case 403. A pair of movable bodies 407*a* and 407*b* are swingably mounted on the case 403 in the vicinity of the permanent magnets 405*a* and 405*b*.

A coil 409*a* and a tapper 411*a* are mounted on the movable body 407*a* mounted on the left side of the case 403. The coil 409*a* causes the movable body 407*a* to swing by magnetically interacting with the permanent magnets 405*a* and 405*b*. A spring 419*a* is mounted between a projection 415*a* provided projecting from a coil receptacle 413*a* on the movable body 407*a* side and a stopper 417 fixed to the case 403 side, and the spring force of the spring 419*a* forcibly causes the movable body 407*a* to swing so that the tapper 411*a* on the end of the movable body 407*a* swings upward. The movable body 407*b* mounted on the right side of the case 403 is similar to the movable body 407*a*. Sound producing bodies 421*a* and 421*b* are mounted in such positions that they are struck by the tappers 411*a* and 411*b* on the ends of the swinging movable bodies 407*a* and 407*b*. When a drive current flows through the coils 409*b* and 409*b*, the magnetic interaction between the coils 409*b* and 409*b* and the permanent magnets 405*a* and 405*b* causes the movable bodies 407*a* and 407*b* to swing and the tappers 411*a* and 411*b* swing down and strike the sound producing bodies 421*a* and 421*b*.

Because the movable bodies 407*a* and 407*b* are caused to swing by just the magnetic interaction between the permanent magnets 405*a* and 405*b* and the coils 409*b* and 409*b*, there are no grating extraneous mechanical drive noises and the toy can be made to produce specific rhythm sounds.

However, in the initial state before the sound producing bodies 421*a* and 421*b* are struck, it is necessary for the tappers 411*a* and 411*b* on the ends of the movable bodies 407*a* and 407*b* to be put into an upswung state. To achieve this, the springs 419*a* and 419*b* are fitted to the movable bodies 407*a* and 407*b* and the spring force of these springs 419*a* and 419*b* is used to forcibly swing the movable bodies 407*a* and 407*b* and thereby cause the tappers 411*a* and 411*b* on the ends of the movable bodies 407*a* and 407*b* to swing up and remain in an upswung state. Consequently, because when the sound producing bodies 421*a* and 421*b* are to be struck the movable bodies 407*a* and 407*b* are swung by the magnetic interaction between the permanent magnets 405*a* and 405*b* and the coils 409*b* and 409*b* against the resistance of the spring force of the springs 419*a* and 419*b*, it has been necessary to use springs 419*a* and 419*b* having a suitable spring force.

As a result, when there has been variation in the spring force characteristics of the springs, the operation of the musical toy has been unstable. Also, when the musical toy has been used for a long time or when the springs are extended while being removed during repair of the toy, the springs may cease to provide the required spring force and become a cause of defective operation of the toy.

Also, when springs are used not only is it necessary to provide space for mounting tile springs but also at the manufacturing stage the springs sometimes drop or slip off and the manufacturing steps for mounting the springs have been complicated.

Furthermore there has been the problem that while the musical toy is operating the springs, which are mounted in the vicinity of the coils, repeatedly extend and contract and as they do so the coil lead wires sometimes get caught and tangled by the springs, resulting in defective operation of the toy.

This invention was devised in view of these problems, and an object of the invention is to provide a musical toy in which the movable bodies can be held in a predetermined operation-start position without using springs; spring mounting space is thereby made unnecessary and the toy can be made small; the manufacturing process can therefore be simplified and resulting mass production benefits and cost reductions can be achieved, and which can operate reliably and stably over a long period of time.

SUMMARY OF THE INVENTION

To achieve the above-mentioned object and other objects, a first means provided by this invention is a musical toy wherein:

(a) there are provided a toy body, a sound producing body and a control device;

(b) the toy body comprises a first permanent magnet and a swinging body swingably mounted in the vicinity of the first permanent magnet;

(c) the swinging body comprises a tapper for striking the sound producing body and an acting part for magnetically interacting with the first permanent magnet and generating a swinging force;

(d) the acting part comprises a second permanent magnet for swinging the tapper up;

(e) the acting part comprises a coil for swinging down the upswung tapper against the resistance of the second permanent magnet;

(f) the control device comprises rhythm signal generating means for generating a rhythm signal and by supplying this rhythm signal to the coil causes the swinging body to swing according to the rhythm signal; and (g) the sound producing body is disposed in such a position that it is struck by the tapper of the swinging body when the swinging body swings according to the rhythm signal.

To achieve the above-mentioned object and other objects, a second means provided by this invention is a musical toy wherein:

(a) there are provided a plurality of toy bodies, a plurality of sound producing bodies disposed in correspondence with a plurality of musical notes, and a control device;

(b) each of the toy bodies has a first permanent magnet and a swinging body swingably mounted in the vicinity of the first permanent magnet;

(c) the swinging bodies of the toy bodies are severally mounted in correspondence with the plurality of musical notes;

(d) each of the swinging bodies comprises a tapper for striking the sound producing body of the corresponding musical note and an acting part for magnetically interacting with the respective first permanent magnet and generating a swinging force;

(e) each of the acting parts comprises a second permanent magnet for swinging the respective tapper up;

(f) each of the acting parts comprises a coil for swinging down the respective upswung tapper against the resistance of the respective second permanent magnet;

(g) the control device comprises melody signal generating means for generating a melody signal consisting of a plurality of musical notes and by supplying this melody signal to the coils causes the swinging bodies to swing according to the melody signal; and (h) the sound producing bodies are disposed in such positions that they are struck by the tappers of the corresponding swinging bodies when the swinging bodies swing according to the melody signal.

To achieve the above-mentioned object and other objects, a third means provided by this invention is a musical toy wherein:

(a) there are provided a toy body, a sound producing body and a control device;

(b) a coil is fixed inside the toy body;

(c) an arm is horizontally pivotally mounted on one side of the toy body;

(d) a permanent magnet is mounted on the base portion of the arm;

(e) the permanent magnet is disposed facing the coil;

(f) the arm is caused to horizontally pivot by a magnetic interaction force acting between the permanent magnet and the coil;

(g) the control device comprises rhythm signal generating means for generating a rhythm signal and by supplying this rhythm signal to the coil causes the arm to horizontally pivot according to the rhythm signal;

(h) a tapper is mounted on the end of the arm and the sound producing body is disposed in such a position that it is struck by the tapper when the arm horizontally pivots according to the rhythm signal;

(i) the toy body comprises a magnetic body disposed facing the permanent magnet and the arm is forcibly caused to pivot to an initial position by a magnetic interaction force acting between the magnetic body and the permanent magnet; and (j) the magnetic interaction force acting between the magnetic body and the permanent magnet is smaller than the magnetic interaction force acting between the coil and the permanent magnet.

To achieve the above-mentioned object and other objects, a fourth means provided by this invention is a musical toy wherein:

(a) there are provided a toy body, a sound producing body and a control device;

(b) a coil is fixed inside the toy body;

(c) a first arm is horizontally pivotally mounted on one side of the toy body;

(d) a permanent magnet is mounted on the base portion of the first arm;

(e) the permanent magnet is disposed facing the coil;

(f) the first arm is caused to horizontally pivot by a magnetic interaction force acting between the permanent magnet and the coil;

(g) a second arm is horizontally pivotally mounted on the other side of the toy body;

(h) the second arm is linked to the base portion of the first arm and is caused to horizontally pivot in conjunction with the first arm;

(i) the control device comprises rhythm signal generating means for generating a rhythm signal and by supplying this rhythm signal to the coil causes the first and second arms to horizontally pivot according to the rhythm signal;

(j) a sound producing body is mounted on the end of each arm horizontally pivoting according to the rhythm signal;

(k) the toy body comprises a magnetic body disposed facing the permanent magnet and both of the arms are forcibly caused to pivot to an initial position by a magnetic interaction force acting between the magnetic body and the permanent magnet; and (l) the magnetic interaction force acting between the magnetic body and the permanent magnet is smaller than the magnetic interaction force acting between the coil and the permanent magnet.

To achieve the above-mentioned object and other objects, a fifth means provided by this invention is a musical toy wherein:

(a) there are provided a plurality of electrically or optically connected toy bodies;

(b) each of the toy bodies comprises a permanent magnet and a swinging body swingably mounted in the vicinity of the permanent magnet, and the swinging body is provided with a coil for magnetically interacting with the permanent magnet and causing the swinging body to swing;

(c) each of the toy bodies comprises a sound producing body disposed in such a position that it is struck by the swinging body;

(d) each of the toy bodies comprises switch means and principal operating means for principally operating when the switch means is operated;

(e) each principal operating means comprises starting signal outputting means for outputting a starting signal and tapping signal outputting means for outputting a tapping signal;

(f) each of the toy bodies comprises subordinate operating means for subordinately operating when detecting an inputting of the starting signal; and (g) each subordinate operating means comprises driving signal supplying means for when detecting an inputting of the tapping signal supplying a driving signal to the respective coil based on the tapping signal.

To achieve the above-mentioned object and other objects, a sixth means provided by this invention is a musical toy wherein:

(a) there are provided a plurality of electrically or optically connected toy bodies;

(b) each of the toy bodies comprises a permanent magnet and a swinging body swingably mounted in the vicinity of the permanent magnet, and the swinging body is provided with a coil for magnetically interacting with the permanent magnet and causing the swinging body to swing;

(c) each of the toy bodies comprises a sound producing body disposed in such a position that it is struck by the swinging body;

(d) each of the toy bodies comprises switch means and principal operating means for principally operating when the switch means is operated;

(e) each principal operating means comprises starting signal outputting means for outputting a starting signal, tapping signal outputting means for outputting a tapping signal consisting of a plurality of parts, and assignment signal outputting means for outputting an assignment signal assigning tapping signals of the individual parts to respective toy bodies;

(f) each of the toy bodies comprises subordinate operating means for subordinately operating when detecting an inputting of the starting signal; and (g) each subordinate operating means comprises driving signal supplying means for when detecting an inputting of the tapping signal consisting of a plurality of parts detecting the tapping signal of the part assigned to that toy body by the assignment signal and supplying a driving signal to the respective coil based on the tapping signal of this assigned part.

In the first means of this invention, there are provided a toy body, a sound producing body and a control device; the toy body comprises a first permanent magnet and a swinging body, and this swinging body comprises a tapper for striking the sound producing body and an acting part for magnetically interacting with the first permanent magnet and generating a swinging force. The acting part comprises a second permanent magnet for swinging the tapper up and a coil for swinging down the upswung tapper, and when rhythm signal generating means provided in the control device supplies a rhythm signal to the coil, the swinging body swings and causes the tapper to strike the sound producing body according to the rhythm signal.

By providing a second permanent magnet in this way it is possible to realize a musical toy in which the tapper on the end of the swinging body can be swung up and kept upswung without using any springs; space for spring mounting is thereby made unnecessary and the toy can be made small; the manufacturing process can be simplified and resulting mass production benefits and cost reductions can be achieved, and which can operate stably over a long period of time.

Also, because the sound producing body is struck by a tapper on the end of a swinging body swinging in accordance with a rhythm signal, the toy can be made to produce specific rhythm sounds and can thereby be made entertaining.

In the second means of this invention, there are provided a plurality of toy bodies, a plurality of sound producing bodies disposed in correspondence with a plurality of musical notes, and a control device; each of the toy bodies has a first permanent magnet and a swinging body, and the swinging bodies of the toy bodies are severally mounted in correspondence with the plurality of musical notes. Each of the swinging bodies comprises a tapper for striking the sound producing body of the corresponding musical note and an acting part for magnetically interacting with the respective first permanent magnet and generating a swinging force; each of the acting parts comprises a second permanent magnet for swinging the respective tapper up and a coil for swinging down the respective upswung tapper; and when melody signal generating means provided in the control device supplies a melody signal to the coils the swinging bodies swing and cause the tappers to strike the corresponding sound producing bodies according to the melody signal.

By providing second permanent magnets in this way it is possible to realize a musical toy in which the tappers on the ends of the swinging bodies can be swung up and kept upswung without using any springs; space for spring mounting is thereby made unnecessary and the toy can be made small; the manufacturing process can be simplified and resulting mass production benefits and cost reductions can be achieved, and which can operate stably over a long period of time.

Also, because the sound producing bodies are struck by tappers on the ends of swinging bodies swinging in accordance with a melody signal, the toy can be made to produce specific melody sounds and can thereby be made entertaining.

In the third means of the invention, a coil is fixed inside a toy body, a permanent magnet is mounted on the base portion of an arm mounted on one side of the toy body, and the arm is free to be horizontally pivoted by a magnetic interaction force acting between this permanent magnet and the coil. A control device comprises rhythm signal generating means for generating a rhythm signal, and when by supplying this rhythm signal to the coil the control device causes the arm to horizontally pivot according to the rhythm signal, a tapper mounted on the end of this horizontally pivoting arm strikes a sound producing body and produces a rhythm sound. Also, a magnetic body is disposed in such a position that it magnetically interacts with the permanent magnet and forcibly causes the arm to pivot to an initial position.

By providing the magnetic body in this way it is possible to realize a musical toy in which the arm can be caused to pivot to an initial position without using any springs; space for spring mounting is thereby made unnecessary and the toy can be made small; the manufacturing process can be simplified and resulting mass production benefits and cost reductions can be achieved, and which can operate stably over a long period of time.

Also, because the arm is horizontally pivoted in accordance with a rhythm signal, the tapper mounted on the end of this arm can be made to strike a sound producing body and produce specific rhythm sounds and the musical toy can thereby be made entertaining.

In the fourth means of this invention, a coil is fixed inside a toy body, a permanent magnet is mounted on the base portion of a first arm mounted on one side of the toy body, and the first arm is free to be horizontally pivoted by a magnetic interaction force acting between this permanent magnet and the coil. Also, on the other side of the toy body a second arm is linked to the base portion of the first arm and is caused to horizontally pivot in conjunction with the first arm. A control device comprises rhythm signal generating means for generating a rhythm signal and by supplying this rhythm signal to the coil causes the first and second arms to horizontally pivot according to the rhythm signal. At this time, the pair of arms move in a hand-clapping action and sound producing bodies mounted on the ends of the arms are clapped together and produce a rhythm sound. Also, there is provided a magnetic body disposed in such a position that it magnetically interacts with the permanent magnet and forcibly causes the pair of arms to pivot to an initial position.

By providing the magnetic body in this way it is possible to realize a musical toy in which the pair of arms can be caused to pivot to an initial position without using any springs; space for spring mounting is thereby made unnecessary and the toy can be made small; the manufacturing process can be simplified and resulting mass production benefits and cost reductions can be achieved, and which can operate stably over a long period of time.

Also, because the pair of arms are horizontally pivoted in accordance with a rhythm signal, the toy can be made to clap together the tappers mounted on the ends of the arms and produce specific rhythm sounds and can thereby be made entertaining.

In the fifth means of the invention, there are provided a plurality of electrically or optically connected toy bodies; each of the toy bodies comprises a permanent magnet and a swinging body swingably mounted in the vicinity of the permanent magnet; the swinging body is provided with a coil for magnetically interacting with the permanent magnet and causing the swinging body to swing; and there are provided sound producing bodies disposed in such positions that they are struck by the swinging bodies. When drive signals are supplied to the coils the swinging bodies swing and strike the sound producing bodies, and sounds can be produced with specific rhythms and tempos.

Because the swinging bodies are caused to swing by magnetic interactions between permanent magnets and coils in this way, there are no grating mechanical drive noises and the toy can be made to accurately and faithfully produce sounds with delicate rhythms and tempos. Also, because the swinging bodies are caused to swing only by magnetic interactions between permanent magnets and coils, the constitution is simple and the assembly work can be made simple.

Furthermore, when its own switch means is operated each of the toy bodies operates principally and outputs a starting signal and a tapping signal to the other toy bodies, and when the other toy bodies detect an inputting of the starting signal they operate subordinately and swing their swinging bodies and strike their sound producing bodies based on the tapping signal and produce sounds with a specific rhythm and tempo.

Because one toy body operates principally and the other toy bodies are made to operate subordinately in this way, the plurality of toy bodies can be made to operate in precise synchrony and the entertainment of a synchronized performance can be realized.

Also, because the toy bodies each produce rhythm sounds by swinging their swinging bodies and striking their sound producing bodies, it looks just like the toy bodies are creating the tune themselves, and a very interesting musical toy can therefore be provided.

In the sixth means of the invention, because the toy body operating principally outputs to the other toy bodies a starting signal, a tapping signal consisting of a plurality of parts, and an assigning signal which assigns the tapping signal of the parts to respective toy bodies, and when they detect the inputting of the starting signal the other toy bodies operate subordinately and their swinging bodies swing based on the tapping signals of the parts assigned to them from the tapping signal consisting of the plurality of parts, it is possible for the rhythms and tempos performed to be varied and the toy can be made to produce sounds with more complex and delicate rhythms and tempos.

BRIEF DESCRIPTION OF THE DRAWINGS

FIG. 14 is a view illustrating the open state of a pair of arms of the preferred embodiment of FIG. 8;

FIG. 15 is a view illustrating the closed state of the pair of arms of the preferred embodiment of FIG. 8;

FIG. 18 is a block diagram showing the linked state of a plurality of toy bodies of the preferred embodiment of FIG. 17;

FIG. 19 is an exterior perspective view of a toy body of the preferred embodiment of FIG. 17;

FIG. 20 is a perspective view showing the toy body of FIG. 19 from the rear;

FIG. 22 is an output timing graph showing the output timing of a starting signal, a tapping signal and a mode signal;

FIG. 23 is a waveform graph of a tapping signal;

FIG. 24 is a waveform graph of a mode signal;

DETAILED DESCRIPTION OF THE PREFERRED EMBODIMENTS

Preferred embodiments of the invention will now be described with reference to the accompanying drawings.

Figure 1:
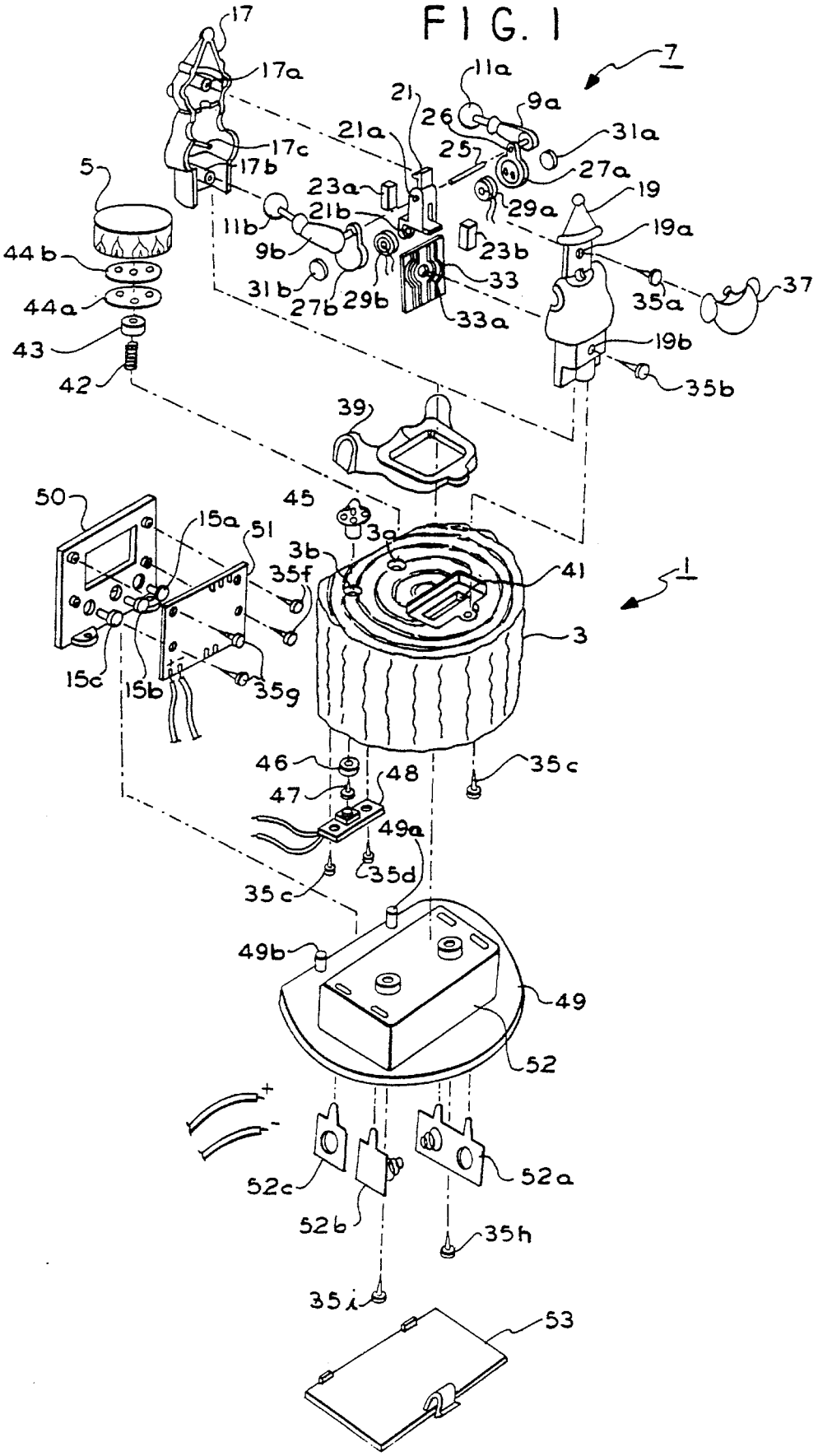
FIG. 1 is an exploded perspective view of a preferred embodiment of a musical toy according to the invention.
Figure 2:
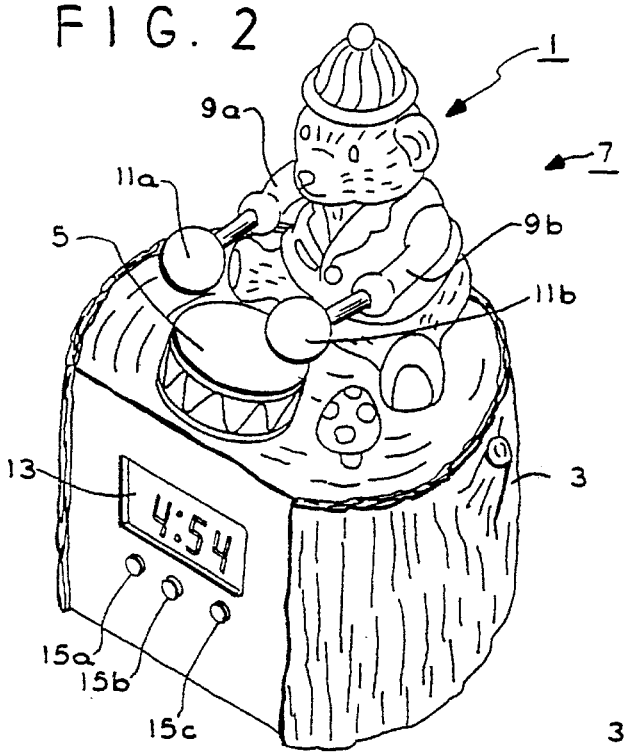
FIG. 2 is an exterior perspective view of the musical toy shown in FIG. 1.

FIG. 1 is an exploded perspective view of a musical toy according to the invention, and FIG. 2 is an exterior perspective view of the same musical toy.

First, the overall construction of the toy will be described with reference to FIG. 2.

This musical toy 1 has a pedestal 3, a sound producing body 5 mounted on the pedestal 3, and a toy body 7 removably mounted on the pedestal 3. The pedestal 3 contains a control device 54 which will be further discussed later. The sound producing body 5 consists of members made of synthetic resin or the like and is formed into the shape of a musical instrument such as a tambourine or some other suitable shape such as that of a bone or a shell. The toy body 7 consists of members made of synthetic resin or the like and is of a suitable shape such as that of an animal or a doll. Swinging bodies 9*a* and 9*b* are mounted independently swingably on the sides of the toy body 7. Tappers 11*a* and 11*b* are mounted on the ends of this pair of swinging bodies 9*a* and 9*b*. The sound producing body 5 is mounted in such a position that it is struck by the tappers 11*a* and 11*b* when they swing. A display 13 and switches 15*a*, 15*b* and 15*c* are mounted on a front panel of the pedestal 3.

Next, the constitution of the assembly of the musical toy 1 will be described with reference to FIG. 1.

The toy body 7 has a front frame part 17 and a rear frame part 19; pillars 17*a* and 17*b* and a pin 17*c* are provided projecting from the front frame part 17, and holes 19*a* and 19*b* are provided in the rear frame part 19. A mounting part 21 is disposed in a substantially central portion of the toy body 7, and a permanent magnet 23*a* and a permanent magnet 23*b* are respectively mounted on the front and rear of the mounting part 21. These permanent magnets 23*a* and 23*b* constitute first permanent magnets. Holes 21*a* and 21*b* are provided in the mounting part 21, and the mounting part 21 is fixed in the substantially central portion of the toy body 7 by the pin 17*c* being passed through the hole 21*b*. A pin 25 is passed through the holes 21*a* in the mounting part 21, and the ends of the pin 25 are passed through holes 26 in the swinging bodies 9*a* and 9*b*. By the pin 25 being fitted into the holes 26, the pair of swinging bodies 9*a* and 9*b* are mounted on the pin 25 swingably thereabout.

A case 27*a* consisting of members made of synthetic resin or the like is integrally mounted on the swinging body 9*a*, and a coil 29*a* is mounted in the case 27*a*. On the rear side of the case 27*a*, i.e. the opposite side to that on which the coil 29*a* is mounted, a thin-plate rubber magnet 31*a* is mounted.

Similarly, a case 27*b* consisting of members made of synthetic resin or the like is integrally mounted on the other swinging body 9*b*, and a coil 29*b* is mounted in the case 27*b*. A thin-plate rubber magnet 31*b* is mounted on the rear side of the case 27*b*, i.e. the opposite side to that on which the coil 29*b* is mounted.

The coils 29*a* and 29*b* and the rubber magnets 31*a* and 31*b* are all disposed in such positions that they face the first permanent magnets 23*a* and 23*b*, and these coils 29*a* and 29*b* and rubber magnets 31*a* and 31*b* constitute interacting parts which generate swinging forces by magnetically interacting with the first permanent magnets 23*a* and 23*b*. The rubber magnets 31*a* and 31*b* constitute second permanent magnets which magnetically interact with the first permanent magnets 23*a* and 23*b* respectively and cause the respective tappers 11*a* and 11*b* to swing up. When driving currents flow through the coils 29*a* and 29*b*, the respective swinging bodies 9*a* and 9*b* are caused to swing, and the raised tappers 11*a* and 11*b* are swung down against the resistance of the rubber magnets 31*a* and 31*b* so that they strike the sound producing body 5.

A circuit board 33 is disposed below the mounting part 21, and a hole 33*a* is formed in a substantially central portion of the circuit board 33. Lead wires from the rubber magnets 31*a* and 31*b* are connected to this circuit board 33.

In the preferred embodiment shown in FIG. 1, the rubber magnets 31*a* and 31*b* constituting the second permanent magnets are disposed to the outer sides of the corresponding coils 29*a* and 29*b*; however, the invention is not limited to this configuration, and the rubber magnets 31*a* and 31*b* constituting the second permanent magnets may alternatively be disposed to the inner sides of the coils 29*a* and 29*b*, i.e. between the first permanent magnets 23*a* and 23*b* and the coils 29*a* and 29*b*. In this case, the receiving surfaces of the cases 27*a* and 27*b* for accommodating the coils 29*a* and 29*b* are formed facing outward and the rubber magnets 31*a* and 31*b* constituting the second permanent magnets are affixed to the inner sides of the cases 27*a* and 27*b*.

Also, although in the preferred embodiment shown in FIG. 1 thin-plate rubber magnets 31*a* and 31*b* were used as the second permanent magnets, the invention is not limited to this and any suitable permanent magnets, for example ferrite or rare earth magnets can be used.

The assembly of the toy body 7 will now be described.

With the permanent magnets 23*a* and 23*b* and the swinging bodies 9*a* and 9*b* fitted to the mounting part 21, the mounting part 21 is fitted in the substantially central portion of the front frame part 17 by the pin 17*c* of the front frame part 17 being passed through the hole 21*b* in the mounting part 21.

Next, a pin 35*a* is passed through the hole 19*a* and screwed into the pillar 17*a*. A pin 35*b* is passed through the hole 19*b* and the hole 33*a* and screwed into the pillar 17*b*, and the mounting part 21 and the circuit board 33 are thereby fixed in the front frame part 17 and the rear frame part 19. In this state, the lower end portion of the circuit board 33 projects below the bottom ends of the front frame part 17 and the rear frame part 19. A member 37 and a leg member 39 are then fitted to the toy body 7.

The pedestal 3 will now be described.

A connector socket 41 is mounted in the upper surface of the pedestal 3, and by the above-mentioned projecting lower end portion of the circuit board 33 being inserted into the connector socket 41 the toy body 7 is electrically connected to the pedestal 3. Holes 3*a* and 3*b* are formed in the upper surface of the pedestal 3.

The sound producing body 5 is mounted over the hole 3*a* by way of a spring 42, a spacer 43 and members 44*a* and 44*b*. A button 45 is mounted in the hole 3*b*, and a member 48 is mounted in a position inside the pedestal 3 corresponding to the button 45 by way of a spacer 46 and a member 47 by means of screws 35*c* and 35*d*. The button 45 and the spacer 46, the member 47 and the member 48 constitute a performance switch.

Figure 3:
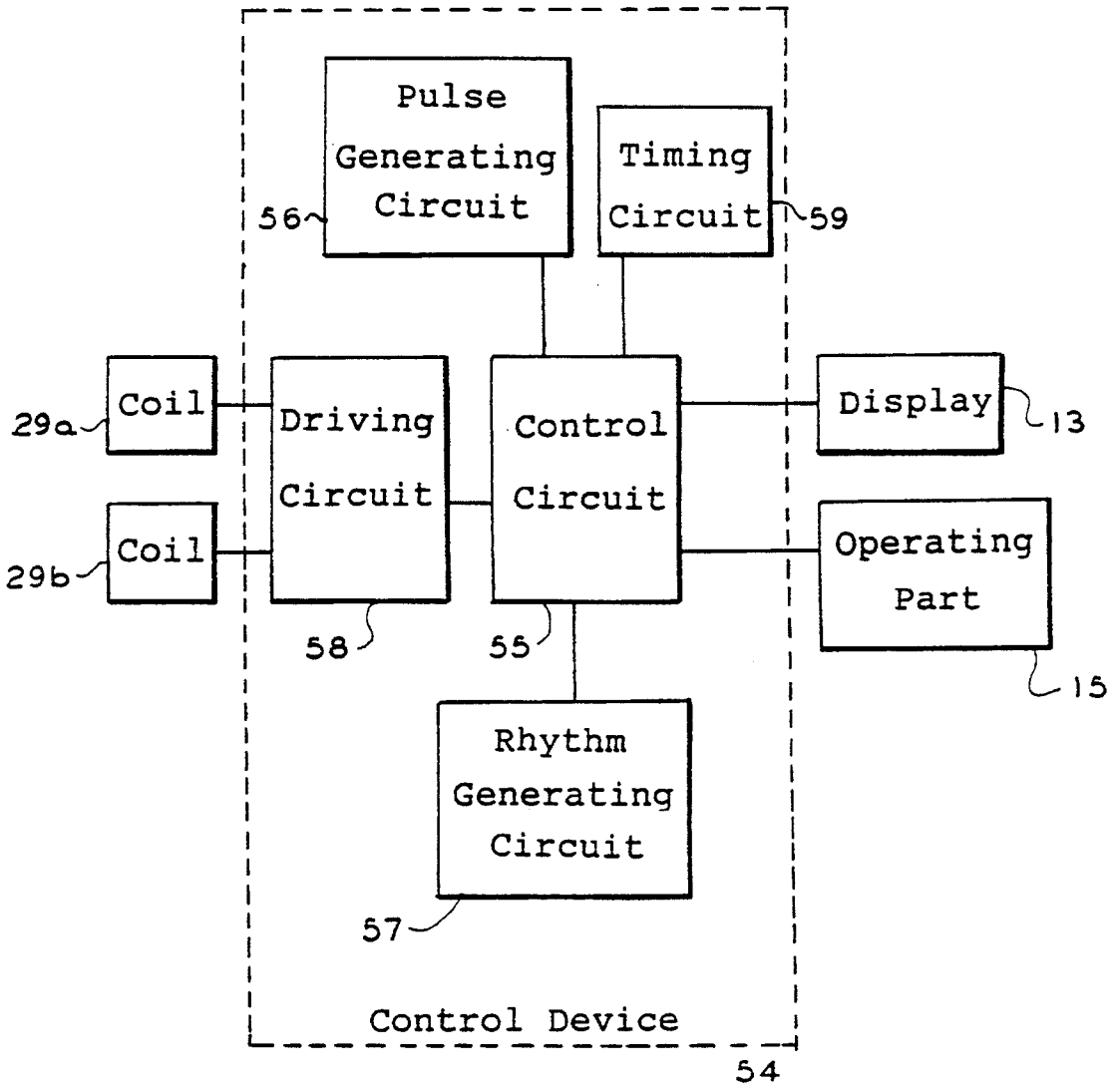
FIG. 3 is a circuit diagram of a control device and its peripherals built into a toy body of the preferred embodiment of FIG. 1.

Pillars 49*a* and 49*b* are mounted projecting from a bottom cover 49 of the pedestal 3; a cover 50 is fitted to the pillars 49*a* and 49*b*, and a circuit board 51 is mounted on the cover 50 by means of screws 35*f* and 35*g*. Switches 15*a*, 15*b* and 15*c* are also mounted on the cover 50. Various circuits, shown in FIG. 3, are provided on the circuit board 51. A battery box 52 is mounted on the bottom cover 49 of the pedestal 3; the battery box 52 is screwed to the pedestal 3 using screws 35*h*, 35*i*, and the bottom cover 49 is thereby fixed to the pedestal 3. Members 52*a*, 52*b* and 52*c* are mounted in the battery box 52, and a battery cover 53 is fitted over an opening in the lower side of the battery box 52. This battery cover 53 can be removed for battery replacement.

The circuit structure of the control device 54 and its peripherals will now be described with reference to FIG. 3.

The control device 54 consists of one integrated circuit. This control device 54 is made up of a control circuit 55, a pulse generating circuit 56, a rhythm generating circuit 57, a driving circuit 58 and a timing circuit 59. The control circuit 55 comprises a calculation processing device such as a microcomputer (CPU), and performs various calculation processes. The pulse generating circuit 56 generates rectangular pulses of a predetermined period and outputs a pulse signal to the control circuit 55. The rhythm generating circuit 57 is rhythm signal generating means for generating a suitable rhythm signal. The control circuit 55 generates a rhythm drive signal based on the signal from the rhythm generating circuit 57. The driving circuit 58 is connected to the control circuit 55 and is also connected to the pair of coils 29*a* and 29*b*. The driving circuit 58 is rhythm drive signal supplying means and supplies rhythm drive signals consisting of pulses to the coils 29*a* and 29*b* according to the signal from the control circuit 55. The timing circuit 59 outputs present time information to the control circuit 55 and outputs timing information such as elapsed time from the present time to the control circuit 55.

The display 13 is connected to the control circuit 55 and displays the present time and an alarm time and the like according to signals from the control circuit 55.

The operating part 15 comprise the plurality of switches 15*a*, 15*b* and 15*c* and the present time and an alarm time and the like can be set by suitably operating these switches 15*a*, 15*b* and 15*c*.

Also, the musical toy 1 has an 'alarm performance function', a 'time report performance function' and a 'demo performance function', and these can be suitably set by operation of the operating part 15 or the button 45. When these various performance functions are set, the control circuit 55 carries out control processing accordingly. For example, when the 'alarm performance function' is set, the control circuit 55 starts a performance operation when an alarm time is reached. When the 'time report performance function' is set, the control circuit 55 starts a performance once every hour, on the hour. With the 'demo performance function' a performance can be started at any time by operating the button 45.

The control device 54 can be mounted in any suitable position, such as inside the toy body 7.

Next, the operation of the preferred embodiment of the invention shown in FIG. 1 will be explained.

First, the initial motionless state wherein no drive current is supplied to the coils 29*a* and 29*b* will be described.

Figure 4:
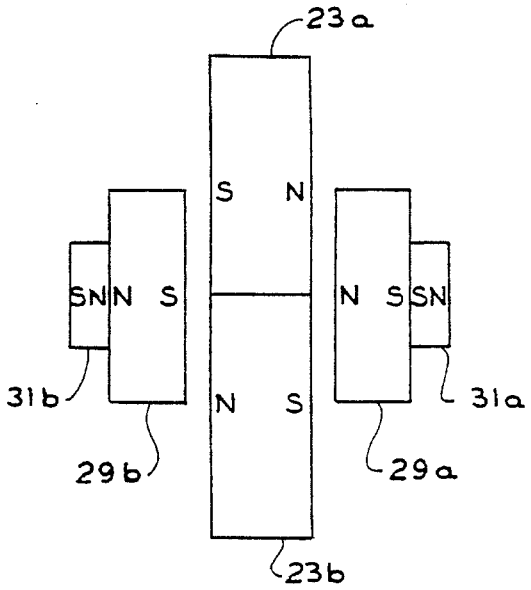
FIG. 4 is a view illustrating a magnetic interaction between a coil and a permanent magnet.

As shown in FIG. 4, for example the right side of the permanent magnet 23*a* positioned at the front is set to magnetic pole N and the right side of the permanent magnet 23*b* positioned at the rear is set to magnetic pole S. The inner side of the rubber magnet 31*a*, i.e. the side close to the coil 29*a*, is set to magnetic pole S. As a result, because the magnetic pole S of the rubber magnet 31*a* and the magnetic pole S of the permanent magnet 23*b* repel and at the same time the magnetic pole S of the rubber magnet 31*a* and the magnetic pole N of the permanent magnet 23*a* attract, the rubber magnet 31*a* causes the swinging body 9*a* to swing forward and swings the tapper 11*a* upward. Similarly, the left side of the permanent magnet 23*a* positioned at the front is set to magnetic pole S and the left side of the permanent magnet 23*b* positioned at the rear is set to magnetic pole N. The inner side of the rubber magnet 31*b*, i.e. the side close to the coil 29*b*, is set to magnetic pole N. As a result, because the magnetic pole N of the rubber magnet 31*b* and the magnetic pole N of the permanent magnet 23*b* repel and at the same time the magnetic pole N of the rubber magnet 31*b* and the magnetic pole S of the permanent magnet 23*a* attract, the rubber magnet 31*b* causes the swinging body 9*b* to swing forward and swings the tapper 11*b* upward. Thus, in the initial state wherein no drive current is supplied to the coils 29*a* and 29*b*, the tappers 11*a* and 11*b* are both swung upward.

Performance operation will now be explained.

The control circuit 55 inputs rectangular pulses of a predetermined period from the pulse generating circuit 56 and also inputs a rhythm signal from the rhythm generating circuit 57, and produces rhythm drive signals by controlling the output timing of the rectangular pulses according to this rhythm signal. These rhythm drive signals are supplied through the driving circuit 58 to the respective coils 29*a* and 29*b*. For example, as rhythm drive signals a pulse signal a such as that shown in FIG. 5(A) is supplied to the coil 29*a* and a pulse signal b such as that shown in FIG. 5(B) is supplied to the coil 29*b*.

First, the case wherein tile pulse signal a shown in FIG. 5(A) is outputted from the driving circuit 58 to the coil 29*a* will be described.

At time t1, a positive pulse is outputted to the coil 29*a*, and magnetic poles form at the sides of the coil 29*a* according to the direction of the current flowing through the coil 29*a*. Here, supposing that a magnetic pole N forms at the left side of the coil 29*a* shown in FIG. 4, i.e. the side facing the permanent magnets 23*a* and 23*b*, the magnetic pole N of the coil 29*a* and the magnetic pole S of the permanent magnet 23*b* will attract and the magnetic pole N of the coil 29*a* and the magnetic pole N of the permanent magnet 23*a* will repel. As a result, the coil 29*a* causes the swinging body 9*a* to swing rearward against the resistance of the above-mentioned magnetic interaction between the rubber magnet 31*a* and the permanent magnets 23*a* and 23*b* and swings the tapper 11*a* mounted on the end of the swinging body 9*a* downward. This causes the tapper 11*a* to strike the sound producing body 5 and produce a sound.

Then, at time t2, when the pulse signal a drops to the L level, because current stops flowing through the coil 29*a*, the magnetic poles formed by the coil 29*a* cease to exist. As a result, the state becomes the same as the initial state wherein no drive current is supplied to the coil 29*a*, and the tapper 11*a* which was swung downward by the action of the coil 29*a* is swung upward again by the magnetic interaction between the rubber magnet 31*a* and the permanent magnets 23*a* and 23*b*.

And so on and so forth, the operation described above is repeated thereafter. As a result, every time the pulse signal a rises to the H level the tapper 11*a* strikes the sound producing body 5 and produces a sound.

Next, the case wherein the pulse signal b shown in FIG. 5(B) is outputted from the driving circuit 58 to the coil 29*b* will be described.

At time t3 a positive pulse is outputted to the coil 29*b*, and magnetic poles form at the sides of the coil 29*b* according to the direction of the current flowing through the coil 29*b*. Here, supposing that a magnetic pole S forms at the right side of the coil 29*b* shown in FIG. 4, i.e. the side facing the permanent magnets 23*a* and 23*b*, the magnetic pole S of the coil 29*b* and the magnetic pole N of the permanent magnet 23*b* will attract, and the magnetic pole S of the coil 29*b* and the magnetic pole S of the permanent magnet 23*a* will repel. As a result, the coil 29*b* causes the swinging body 9*b* to swing rearward against the resistance of the above-mentioned magnetic interaction between the rubber magnet 31*b* and the permanent magnets 23*a* and 23*b*, and swings the tapper 11*b* mounted on the end of the swinging body 9*b* downward. This causes the tapper 11*b* to strike the sound producing body 5 and produce a sound.

And so on and so forth, the operation described above is repeated thereafter. As a result, every time the pulse signal b rises to the H level the tapper 11*b* strikes the sound producing body 5 and produces a sound.

Figure 5:
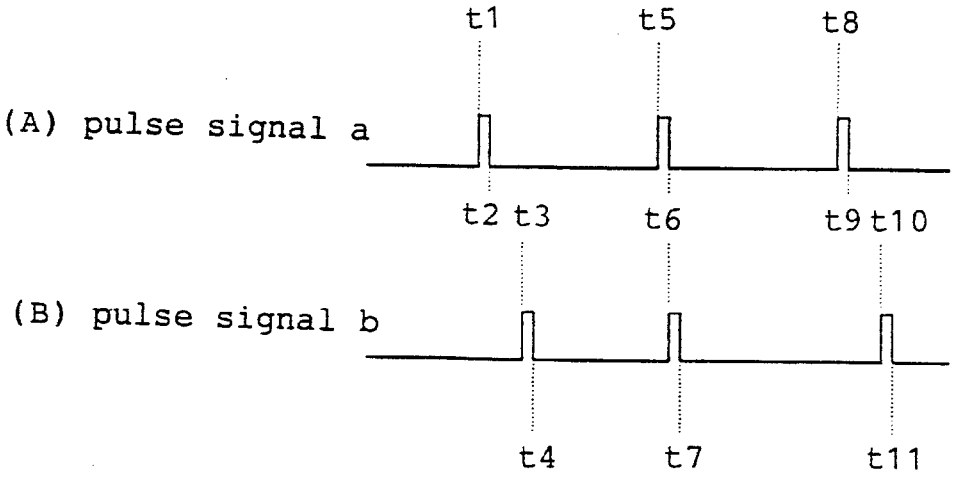
FIG. 5 is a waveform graph of a pulse signal supplied to a coil.

Thus, each time either of the pulse signals a and b supplied from the control device 54 rises to the H level, the respective tapper 11*a* or 11*b* strikes the sound producing body 5 and produces a sound. As a result, when the pulse signals a and b shown in FIG. 5 are supplied to the coils 29*a* and 29*b*, a rhythm sound 'tan, tan, ta, ta, tan, tan . . .' is produced.

Of course, by adjusting the output timing of the respective pulses of the pulse signals a and b supplied from the control device 54, any suitable subtle rhythm sound can be produced.

Also, by producing the pulse signals supplied to the coils 29*a* and 29*b* according to a suitable rhythm sound, any desired subtle rhythm sound can be produced with certainty and easily, and the toy can thereby be made interesting.

Figure 6:
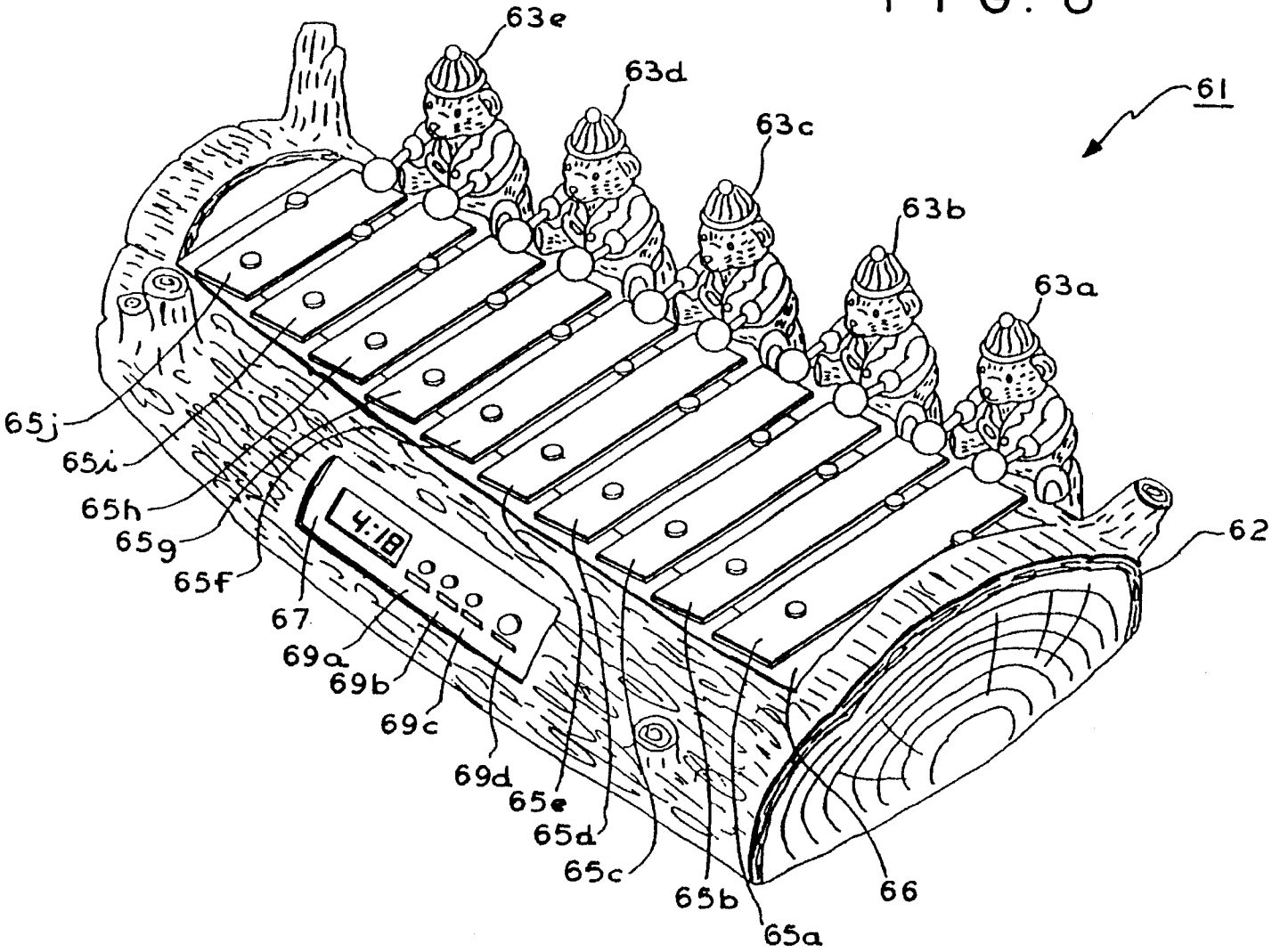
FIG. 6 is an exterior perspective view of another preferred embodiment of the invention.
Figure 7:
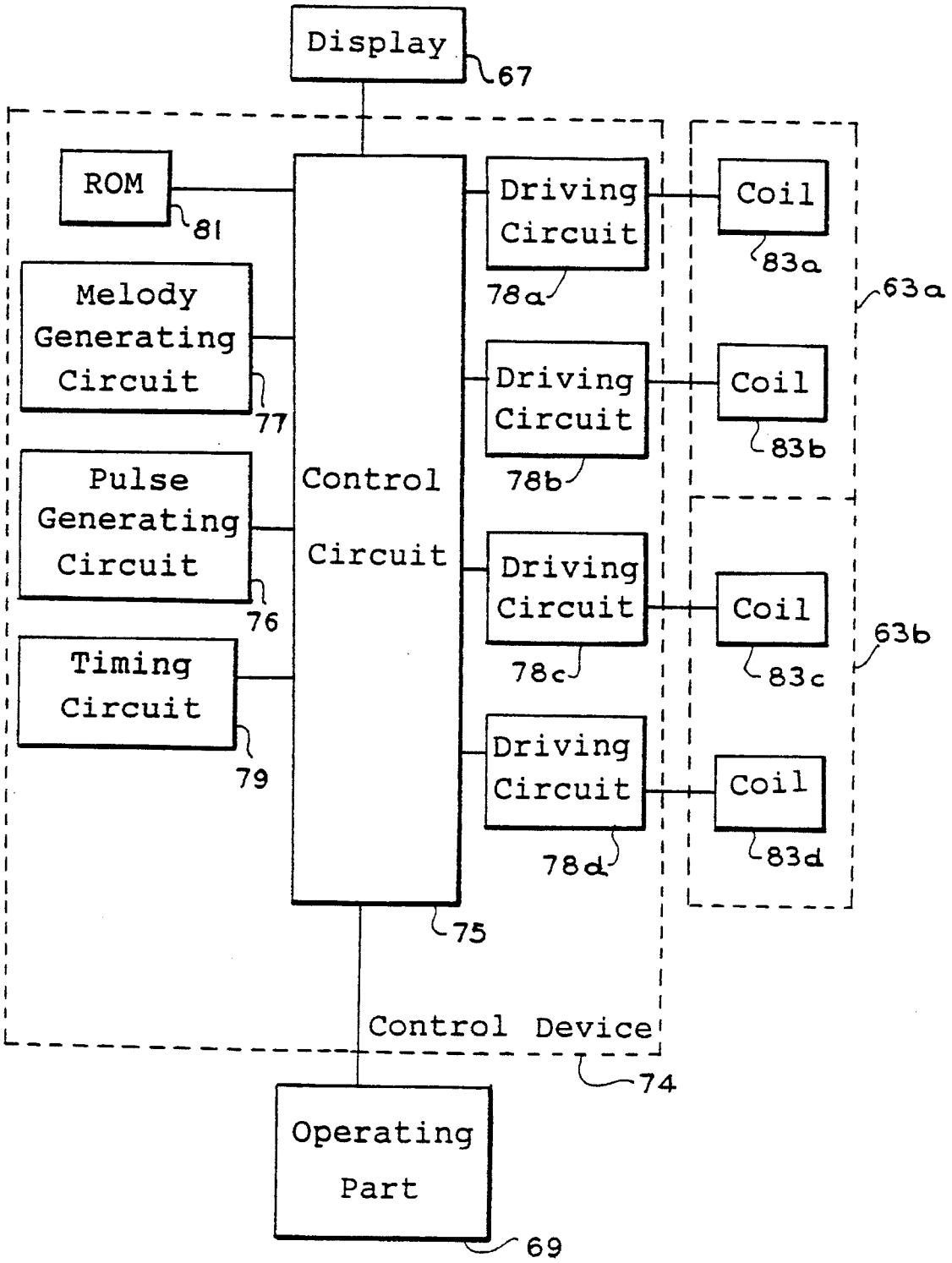
FIG. 7 is a circuit diagram of a control device and its peripherals built into a toy body of the preferred embodiment shown in FIG. 6.

Next, another preferred embodiment of the invention will be described with reference to FIG. 6 and FIG. 7.

First, the overall constitution of the embodiment will be described with reference to FIG. 6.

A musical toy 61 is made up of a plurality of toy bodies 63*a*, 63*b*, . . . mounted on a musical instrument body 62, a plurality of sound producing bodies 65*a*, 65*b*, 65*c*, 65*d*, . . . provided corresponding to a plurality of musical notes, and a control device 74 mounted inside the musical instrument body 62. The construction of each of the toy bodies 63*a*, 63*b*, . . . is the same as that of the toy body 7 shown in FIG. 1.

That is, each of the toy bodies 63*a*, 63*b*, . . . has first permanent magnets and has swinging bodies swingably mounted in the vicinity of the first permanent magnets. The swinging bodies each have a tapper for striking the respective sound producing body and an acting part for magnetically interacting with the first permanent magnets and producing a swinging force. This acting part is provided with a second permanent magnet for swinging up the tapper and a coil for swinging the raised tapper downward against the resistance of the second permanent magnet.

The plurality of sound producing bodies 65*a*, 65*b*, 65*c*, 65*d*, . . . are mounted in such positions that they are struck by the swinging members of the toy bodies 63*a*, 63*b*, . . . . For example, the sound producing bodies 65*a* and 65*b* are mounted in such positions that they are struck by the swinging bodies of the toy body 63*a*, and the sound producing bodies 65*c* and 65*d* are mounted in such positions that they are struck by the swinging bodies of the toy body 63*b*. Also, the plurality of sound producing bodies are arrayed in the order of a musical scale, for example the sound producing bodies 65*a*, 65*b*, 65*c*, 65*d*, . . . being so provided that they produce the notes 'ray', 'me', 'far', 'so'. A cavity 66 for resonance is provided below each of the sound producing bodies 65*a*, 65*b*, 65*c*, 65*d*, . . . . These cavities 66 make it possible for relatively large sounds to be produced by the sound producing bodies 65*a*, 65*b*, 65*c*, 65*d*, . . . . A display 67 and switches 69*a*, 69*b*, 69*c* and 69*d* are mounted on the front of the musical instrument body 62.

Next, the circuit constitution of the control device 74 and its peripherals will be described with reference to FIG. 7.

The control device 74 consists of one integrated circuit. This control device 74 is made up of a control circuit 75, a pulse generating circuit 76, a melody generating circuit 77, driving circuits 78*a*, 78*b*, 78*c*, 78*d*, . . . , a timing circuit 79 and a ROM 81.

The control circuit 75 has a calculation processing device such as a microcomputer (CPU), and performs various calculation processes. The pulse generating circuit 76 generates rectangular pulses of a predetermined period and outputs pulse signals to the control circuit 75. The melody generating circuit 77 is melody signal generating means for generating specific melody signals. The control circuit 75 produces melody drive signals based on signals from the melody generating circuit 77 or the ROM 81. The driving circuits 78*a*, 78*b*, 78*c*, 78*d*, . . . are connected to the control circuit 75 and are individually connected to respective coils 83*a*, 83*b*, 83*c*, 83*d*, . . . The driving circuits 78*a*, 78*b*, 78*c*, 78*d*, . . . . are melody drive signal supplying means, and separately supply melody drive signals consisting of pulses to the respective coils 83*a*, 83*b*, 83*c*, 83*d*, . . . according to signals from the control circuit 75.

The timing circuit 79 outputs present time information through the control circuit 75 and outputs timing information such as elapsed time from the present time to the control circuit 75. The ROM 81 stores a plurality of melodies, and by operating the switches of an operating part 69 melody signals can be read out from the ROM 81. Thus the ROM 81 is melody signal generating means for generating melody signals. The ROM 81 is removably mounted, and by replacing this ROM 81 with another the toy can be made to perform other melodies.

The operating part 69 comprises the switches 69*a*, 69*b*, 69*c* and 69*d*, and by operating these switches the present time and an alarm time and the like can be set and displayed. The display 67 displays the above-mentioned present time and alarm time and the like.

Next, the operation of the preferred embodiment shown in FIG. 6 and FIG. 7 will be described.

First, the plurality of toy bodies 63*a*, 63*b*, . . . are each of the same construction as toy body 7 shown in FIG. 1, and in the initial state wherein no drive current is supplied to the coils 83*a*, 83*b*, 83*c*, 83*d*, . . . , the tappers on the ends of the swinging bodies are all swung upward. When the toy is switched on at the operating part 69, a starting signal is outputted to the control circuit 75 and the melody generating circuit 77 is activated. The control circuit 75 produces a melody drive signal for making the toy perform a specific melody based on a signal from the melody generating circuit 77. This melody drive signal is divided up into its constituent musical notes, and melody drive signals of the notes are supplied individually to the respective coils 83*a*, 83*b*, 83*c*, 83*d*, . . . through the driving circuits 78*a*, 78*b*, 78*c*, 78*d*, . . . .

For example, when performing a melody consisting of the notes 'ray', 'me', 'far', a melody drive signal for the note 'ray' is outputted to the coil 83*a* through the driving circuit 78*a*. After that, a melody drive signal for the note 'me' is outputted to the coil 83*b* through the driving circuit 78*b*, and a melody drive signal for the note 'far' is outputted to the coil 83*c* through the driving circuit 78*c*.

In the toy body 63*a*, when the coil 83*a* inputs the melody drive signal for the note 'ray', a magnetic interaction between the coil 83*a* and the first permanent magnets causes the respective swinging body to swing and the respective tapper is swung downward and strikes the sound producing body 65*a*, producing a 'ray' note sound.

Likewise thereafter, each time the respective coils of the toy bodies 63*a*, 63*b*, . . . input the melody drive signals of the notes 'ray', 'me', 'far', the magnetic interaction between the respective coil and permanent magnets causes the respective swinging body to swing and the respective tapper strikes the respective sound producing body. As a result, the plurality of sound producing bodies 65*a*, 65*b*, 65*c*, 65*d*, . . . corresponding to the plurality of musical notes are struck sequentially by the respective tappers and a melody sound consisting of the notes 'ray', 'me', 'far' is produced.

Thus, because the sound producing bodies are struck by the tappers on the swinging bodies swung in accordance with melody drive signals, the toy can be made to produce specific melody sounds and can thereby be made entertaining.

Also, because the swinging bodies are caused to swing only by the magnetic interaction between permanent magnets and coils, there are no extraneous mechanical noises and melody sounds can be faithfully produced in accordance with delicate melodies.

Furthermore, by changing the ROM 81, the toy can be made to perform other melodies.

Another preferred embodiment of the invention, shown in FIG. 8 to FIG. 15, will now be described.

Figure 8:
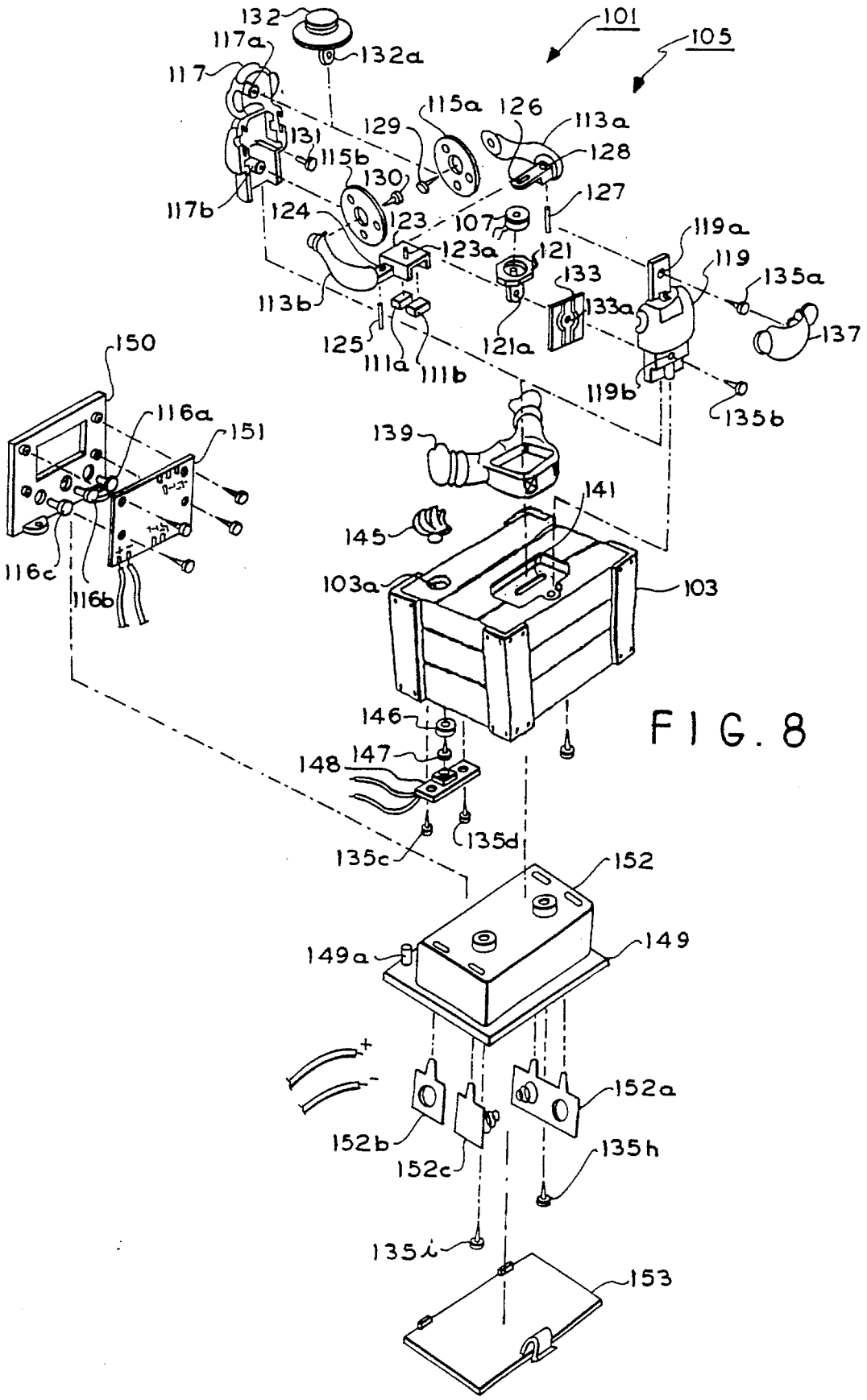
FIG. 8 is an exploded perspective view of another preferred embodiment of the invention.
Figure 9:
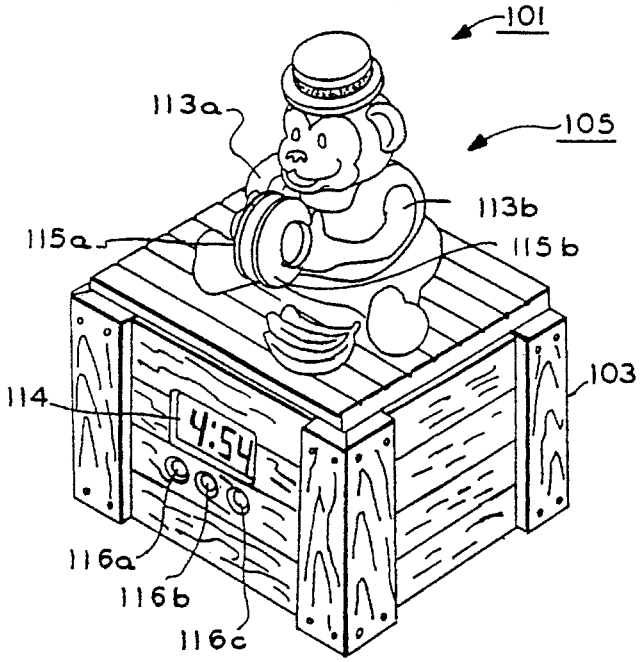
FIG. 9 is an exterior perspective view of the preferred embodiment shown in FIG. 8.
Figure 10:
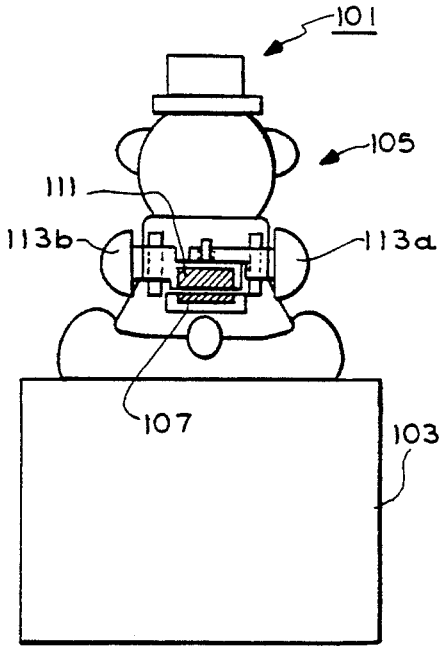
FIG. 10 is a partially sectional view of the preferred embodiment shown in FIG. 8 as seen from the rear.

FIG. 8 is an exploded perspective view of a musical toy according to the invention. FIG. 9 is a perspective view of the exterior of the musical toy shown in FIG. 8, and FIG. 10 is a partly sectional view showing the musical toy shown in FIG. 8 as seen from the rear.

First, the overall constitution of the embodiment will be described.

The musical toy 101 of this preferred embodiment has a pedestal 103 and a toy body 105 removably mounted on the pedestal 103. A control device 154 which will be further discussed later is mounted inside the pedestal 103. A coil 107 is fixed in a substantially central portion of the toy body 105. A first arm 113*b* is mounted on one side of the toy body 105. A permanent magnet 111 is mounted on the base end of the first arm 113*b*. This permanent magnet 111 consists of two permanent magnets 111*a* and 111*b* as will be discussed in detail later, and is disposed in such a position that it faces the coil 107. The first arm 113*b* is so mounted that it is free to be pivoted horizontally by a magnetic interaction between the permanent magnets 111*a* and 111*b* and the coil 107.

A second arm 113*a* is mounted on the other side of the toy body 105. This second arm 113*a* is linked to the base portion of the first arm 113*b* and pivots horizontally in conjunction with the first arm 113*b*.

A sound producing body 115*a* is mounted on the end of the arm 113*a* and a sound producing body 115*b* is mounted on the end of the arm 113*b*. When the pair of arms 113*a* and 113*b* pivot horizontally, the pair of sound producing bodies 115*a* and 115*b* are clapped together and produce a sound.

The pair of sound producing bodies 115*a* and 115*b* consist of synthetic resin members or metal members or the like and each formed into the shape of a suitable musical instrument such as a cymbal. The toy body 105 is made of synthetic resin members and is formed in a suitable animal or doll shape. A display 114 and switches 116*a*, 116*b* and 116*c* are mounted on a front panel of the pedestal 103.

The construction of the assembly of the musical toy 101 will now be described.

The toy body 105 has a front frame 117 and a rear frame 119; pillars 117*a* and 117*b* are provided projecting from the front frame 117 and holes 119*a* and 119*b* are provided in the rear frame 119. The coil 107 is fixed to a mounting part 121 disposed in a substantially central portion of the toy body 105. A hole 121*a* is provided in a mounting portion of the mounting part 121.

Figure 12:
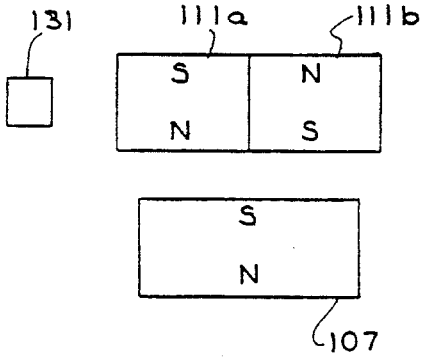
FIG. 12 is a view illustrating the disposition of a magnetic member and permanent magnets and a coil.

A frame 123 is fixed to the base portion of the arm 113*b*. The frame 123 is disposed above and facing the mounting part 121, and the permanent magnet 111*a* is mounted on the front of the frame 123 and the permanent magnet 111*b* is mounted on the rear of the frame 123. Here, the permanent magnet 111*a* positioned at the front and the permanent magnet 111*b* positioned at the rear have opposite magnetic poles. For example, as shown in FIG. 12, the lower side of the permanent magnet 111*a* positioned at the front, i.e. the side facing the coil 107, is set to magnetic pole N and the lower side of the permanent magnet 111*b* positioned at the rear is set to magnetic pole S.

A pillar 123*a* is provided projecting from the upper surface of the frame 123, and a hole 124 for a pin 125 to pass through is provided in a portion linking the frame 123 and the left arm 113*b* proper. A hole 126 through which the pillar 123*a* passes and a hole 128 for a pin 127 to pass through are provided in the right side arm 113*a*. The pin 127 and the pin 125 are fixed to the front frame 117 or the rear frame 119 in suitable positions.

The frame 123 is moved rearward by the magnetic interaction force between the coil 107 and the permanent magnets 111*a* and 111*b*, and this rearward movement of the frame 123 causes the pair of arms 113*a* and 113*b* to pivot horizontally about the pins 127 and 125 respectively.

Thus the pin 125 is the pivoting axis of the arm 113*b* and pivotally supports the arm 113*b*.

The sound producing body 115*a* is attached to the end of the second arm 113*a* by a screw 129, and the sound producing body 115*b* is attached to the end of the arm 113*b* by a screw 130. As a result, when the arms 113*a* and 113*b* pivot horizontally toward each other, the pair of sound producing bodies 115*a* and 115*b* are clapped together and produce a sound.

A magnetic body 131 such as a steel rivet is fixed to a central portion of the inner side of the front frame 117. This magnetic body 131 is disposed in such a position that it faces the permanent magnets 111*a* and 111*b*, and when no drive current is being supplied to the coil 107 the magnetic body 131 attracts the permanent magnets 111*a* and 111*b* and the frame 123 is thereby forcibly moved forward. As a result, the pair of arms 113*a* and 113*b* are pivoted open horizontally away from each other. That is, the magnetic body 131 is provided for the purpose of forcibly pivoting the pair of arms 113*a* and 113*b* horizontally to their initial positions by magnetically interacting with the permanent magnets 111*a* and 111*b*. This magnetic interaction force between the magnetic body 131 and the permanent magnets 111*a* and 111*b* is by design smaller than the magnetic interaction force between the coil 107 and the permanent magnets 111*a* and 111*b*.

A hat 132 is disposed on the top of the front frame 117 and the rear frame 119, and a hole 132*a* is provided in a mounting portion of the hat 132. A circuit board 133 is disposed below the mounting part 121, and a hole 133*a* is provided in a substantially central portion of the circuit board 133. Lead wires from the coil 107 are connected to this circuit board 133.

In this preferred embodiment a rivet consisting of a steel member is used as the magnetic body 131; however, the invention is not limited to this and any suitable permanent magnet, for example a ferrite or rare earth magnet or the like, may be used.

The process by which the toy body 105 is assembled will now be described.

First, the coil 107 is fixed to the mounting part 121 and the permanent magnets 111*a* and 111*b* are fixed to the frame 123. The pillar 123*a* of the frame 123 is then passed through the hole 126 in the arm 113*a*, the pin 127 is passed through the hole 128, and the pin 125 is passed through the hole 124. A screw 135*a* is passed through the holes 119*a* and 132*a* and screwed into the pillar 117*a*, and a screw 135*b* is passed through the hole 119*b*, the hole 133*a* and the hole 121*a* and screwed into the pillar 117*b*, whereby the mounting part 121 and the circuit board 133 are fixed in the substantially central portion of the front frame 117 and the rear frame 119. In this state the lower end portion of the circuit board 133 projects below the bottom ends of the front frame 117 and the rear frame 119.

By the pin 125 being passed through the hole 124 and the pin 127 being passed through the hole 128 in this way, the pair of arms 113*a* and 113*b* are mounted pivotally horizontally about the pins 127 and 125. After that, a neck member 137 and a leg member 139 are fitted to the toy body 105.

Next, the pedestal 103 will be described. A connector socket 141 is provided in the upper surface of the pedestal 103, and by the above-mentioned projecting lower end portion of the circuit board 133 being inserted into the connector socket 141 the toy body 105 is electrically connected to the pedestal 103. A hole 103*a* is also provided in the upper surface of the pedestal 103. A button 145 shaped like a bunch of bananas is mounted in the hole 103*a*, and a contact member 148 is mounted in a position inside the pedestal 103 corresponding to the button 145 by way of a spacer 146 and a member 147 by means of screws 135*c* and 135*d*. The button 145, the spacer 146, the member 147 and the contact member 148 constitute a performance switch.

Two pillars 149*a* are provided projecting from a base cover 149 of the pedestal 103; a cover 150 is fitted to these pillars 149*a*, and a circuit board 151 is mounted on the cover 150 by means of screws. The switches 116*a*, 116*b* and 116*c* are also mounted on the cover 150.

Figure 11:
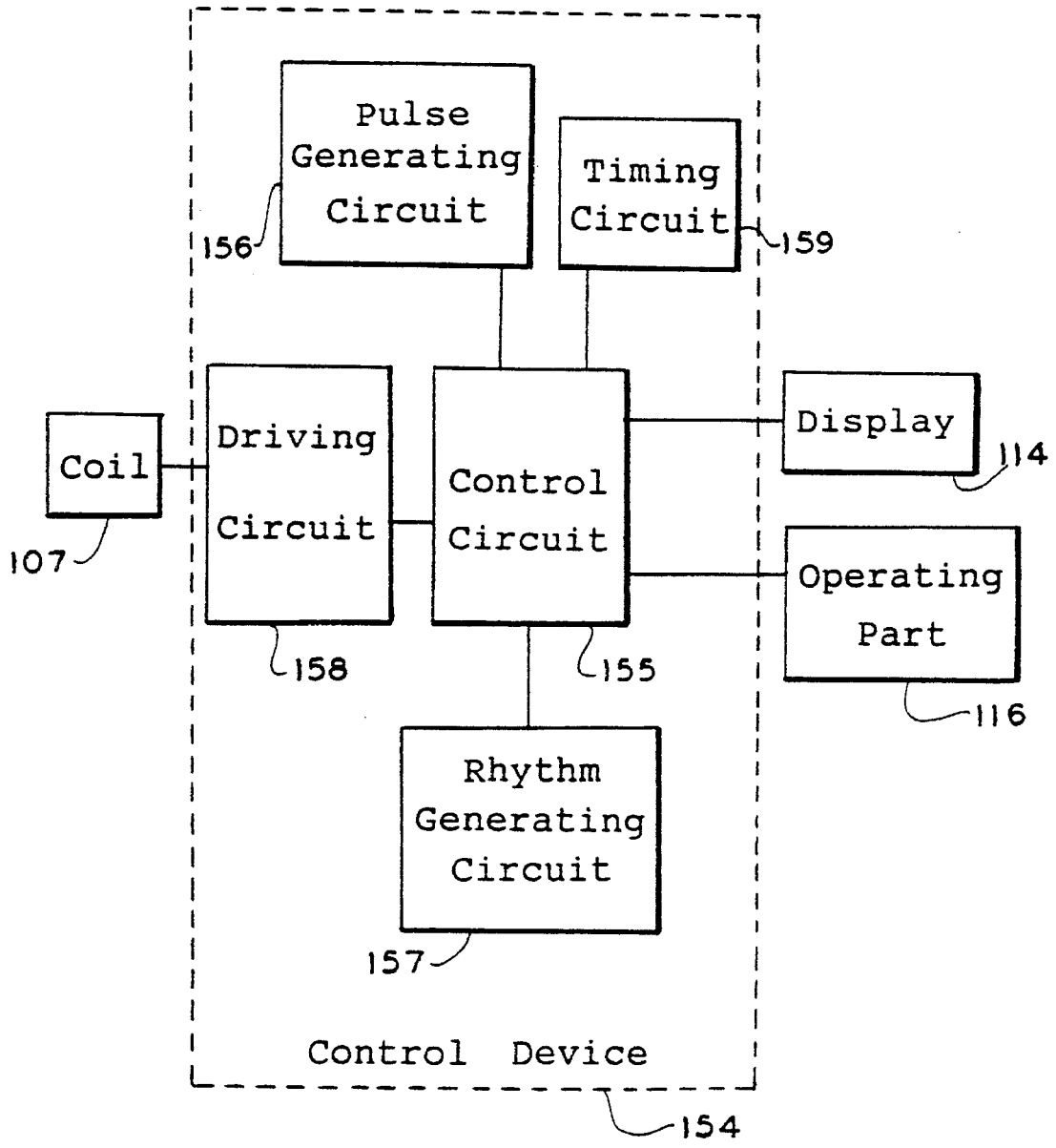
FIG. 11 is a circuit diagram of a control device and its peripherals built into the musical toy of the preferred embodiment shown in FIG. 8.

Circuit parts such as a control device 154 shown in FIG. 11 are provided on the circuit board 151. A battery box 152 is mounted on the base cover 149 of the pedestal 103, and by the battery box 152 being fixed to the pedestal 103 by means of screws 135*h* and 135*i* the base cover 149 is fixed to the pedestal 103. Members 152*a*, 152*b* and 152*c* are mounted in the battery box 152, and a battery cover 153 is fitted over a lower opening portion of the battery box 152. This battery cover 153 can be removed for battery replacement.

Next, the circuit constitution of the control device 154 and its peripherals built onto the circuit board 151 will be described with reference to FIG. 11.

The control device 154 consists of one integrated circuit. This control device 154 is made up of a control circuit 155, a pulse generating circuit 156, a rhythm generating circuit 157, a driving circuit 158 and a timing circuit 159.

The control circuit 155 comprises a calculation processing device such as a microcomputer (CPU), and performs various calculation processes. The pulse generating circuit 156 generates rectangular pulses of a predetermined period and outputs a pulse signal to the control circuit 155. The rhythm generating circuit 157 is rhythm signal generating means for generating a suitable rhythm signal. The control circuit 155 generates a rhythm drive signal based on the signal from the rhythm generating circuit 157. The driving circuit 158 is connected to the control circuit 155 and is also connected to the coil 107. The driving circuit 158 is rhythm drive signal supplying means and supplies rhythm drive signals consisting of pulses to the coil 107 according to a signal from the control circuit 155. The timing circuit 159 outputs present time information to the control circuit 155 and outputs timing information such as elapsed time from the present time to the control circuit 155.

The display 114 is connected to the control circuit 155, and displays the present time and an alarm time and the like according to signals from the control circuit 155.

The operating part 116 comprises the plurality of switches 116*a*, 116*b* and 116*c*, and the present time and an alarm time and the like can be set by suitably operating these switches 116*a*, 116*b* and 116*c*.

Also, the musical toy 101 has an 'alarm performance function', a 'time report performance function' and a 'demo performance function', and these can be suitably set by operation of the operating part 116 or the button 145. When these various performance functions are set, the control circuit 155 carries out control processing accordingly. For example, when the 'alarm performance function' is set, the control circuit 155 starts a performance operation when an alarm time is reached. When the 'time report performance function' is set, the control circuit 155 starts a performance once every hour, on the hour. With the 'demo performance function', a performance can be started at any time by operating the button 145.

The control device 154 can be mounted in any suitable position such as inside the toy body 105.

The operation of the preferred embodiment shown in FIG. 8 through FIG. 15 will now be described.

First, the motionless initial state wherein no drive current is supplied to the coil 107 will be described.

As shown in FIG. 12 the magnetic body 131 is positioned in front of the permanent magnets 111*a* and 111*b*, and because the permanent magnets 111*a* and 111*b* and the magnetic body 131 attract each other this attracting force causes the frame 123 to which the permanent magnets 111*a* and 111*b* are fixed to move forward toward the magnetic body 131.

As the frame 123 is moved forward, the arm 113*a* pivots open horizontally outward about the pin 127 and the arm 113*b* pivots open horizontally outward about the pin 125.

As a result, in the initial state shown in FIG. 14 wherein no drive current is supplied to the coil 107, the pair of arms 113*a* and 113*b* are pivoted open horizontally outward and held in this initial position.

Rhythm performance operation will now be described.

Figure 13:
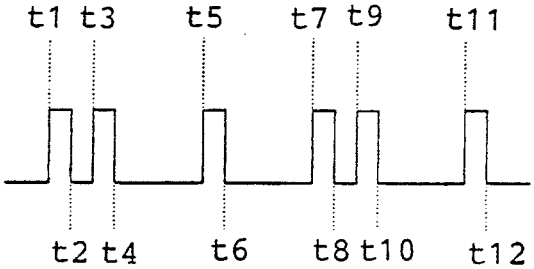
FIG. 13 is a waveform graph of a pulse signal supplied to a coil.

The control circuit 155 inputs rectangular pulses of a predetermined period from the pulse generating circuit 156 and inputs rhythm signals from the rhythm generating circuit 157, and produces a rhythm drive signal by controlling the output timing of the rectangular pulses according to the rhythm signal. This rhythm drive signal is fed to the coil 107 through the driving circuit 158. For example, a pulse signal of the kind shown in FIG. 13 is fed to the coil 107 as the rhythm drive signal. First, at time t1, a positive pulse is outputted to the coil 107 and magnetic poles form at the sides of the coil 107 according to the direction of the current flowing in the coil 107. Here, supposing that at the upper side of the coil 107 as shown in FIG. 12, i.e. at the side facing the permanent magnets 111*a* and 111*b*, a magnetic pole S is formed, because the lower side of the permanent magnet 111*a* is set to magnetic pole N and the lower side of the permanent magnet 111*b* is set to magnetic pole S, the magnetic pole S of the coil 107 and the magnetic pole N of the permanent magnet 111*a* attract and the magnetic pole S of the coil 107 and the magnetic pole S of the permanent magnet 111*b* repel. As a result, the coil 107 causes the permanent magnets 111*a* and 111*b* to move rearward against the above-mentioned magnetic interaction force between the magnetic body 131 and the permanent magnets 111*a* and 111*b*. As a result, because the frame 123 is moved rearward, the pair of arms 113*a* and 113*b* pivot horizontally.

That is, when the frame 123 is thus moved rearward as shown in FIG. 15, the arm 113*a* pivots closed horizontally inward about the pin 127 and the arm 113*b* pivots closed horizontally inward about the pin 125. Thus the pair of arms 113*a* and 113*b* simultaneously move toward each other in a hand-clapping action, and clap the sound producing bodies 115*a* and 115*b* together.

Next, at time t2, when the pulse signal drops to the L level, because the current flowing through the coil 107 stops, the magnetic poles formed by the coil 107 cease to exist. As a result, the state becomes the same as the initial state wherein no drive current is supplied to the coil 107, and the pair of arms 113*a* and 113*b* pivot open horizontally outward and are held in the clapping action starting position. Likewise thereafter, the operation described above is repeated. Therefore, every time the pulse signal rises to the H level, the pair of arms 113*a* and 113*b* pivot horizontally inward and perform a clapping action, and clap the sound producing bodies 115*a* and 115*b* together.

Because as described above the pair of arms 113*a* and 113*b* perform a clapping action according to the output timing of the pulse signal supplied from the control device 154, the sound producing bodies 115*a* and 115*b* are clapped together with a rhythm according to the output timing of the pulse signal, and produce a rhythm sound.

Therefore, when a pulse signal of the output timing shown in FIG. 13 is fed to the coil 107, the sound producing bodies 115*a* and 115*b* produce the rhythm sound 'ta, ta, tan, ta, ta, tan . . .'.

Of course, by adjusting the output timing of the pulse signal supplied from the control device 154, the toy can be made to produce any suitable subtle rhythm sound.

Also, by generating the pulse signal supplied to the coil 107 according to a suitable rhythm sound, the toy can be made to produce any desired subtle rhythm sound with certainty and easily, thereby making the toy more interesting.

Also, although the rhythm drive signal shown in FIG. 13 is such that only when the sound producing bodies 115*a* and 115*b* are to be clapped together to produce a sound a positive pulse signal is outputted, a negative pulse signal can be outputted immediately after this positive pulse signal. If a negative pulse signal is outputted immediately after this positive pulse signal, the pair of arms 113*a* and 113*b* can be caused to pivot open horizontally outward with certainty and return to their hand-clapping action starting positions.

As described above, because the sound producing bodies are clapped together by the arms pivoting horizontally according to a rhythm drive signal, the toy can produce specific rhythm sounds and can thereby be made more interesting.

Also, because the arms are caused to pivot horizontally only by means of the magnetic interaction between permanent magnets and a coil, there is no extraneous mechanical noise and rhythm sounds can be produced faithfully in accordance with delicate rhythm signals.

In the preferred embodiment described above, the pair of arms 113*a* and 113*b* are mounted pivotally horizontally at the sides of the toy body 105, the sound producing bodies 115*a* and 115*b* are mounted at the ends of the pair of arms 113*a* and 113*b*, and the arms 113*a* and 113*b* clap the sound producing bodies 115*a* and 115*b* together when they are caused to pivot horizontally; however, alternatively just one arm may be mounted pivotally horizontally at one side of the toy body 105. In this case, a tapper may be mounted on the end of the horizontally pivotal arm and a sound producing body may be mounted in such a position that it is struck by the tapper, for example on the end of another arm fixed to the toy body 105. Here, the toy can be made even more interesting by the sound producing body being shaped like a drum and the tapper being shaped like a drumstick.

Next, another preferred embodiment of the invention will be described with reference to FIG. 16 through FIG. 32.

Figure 16:
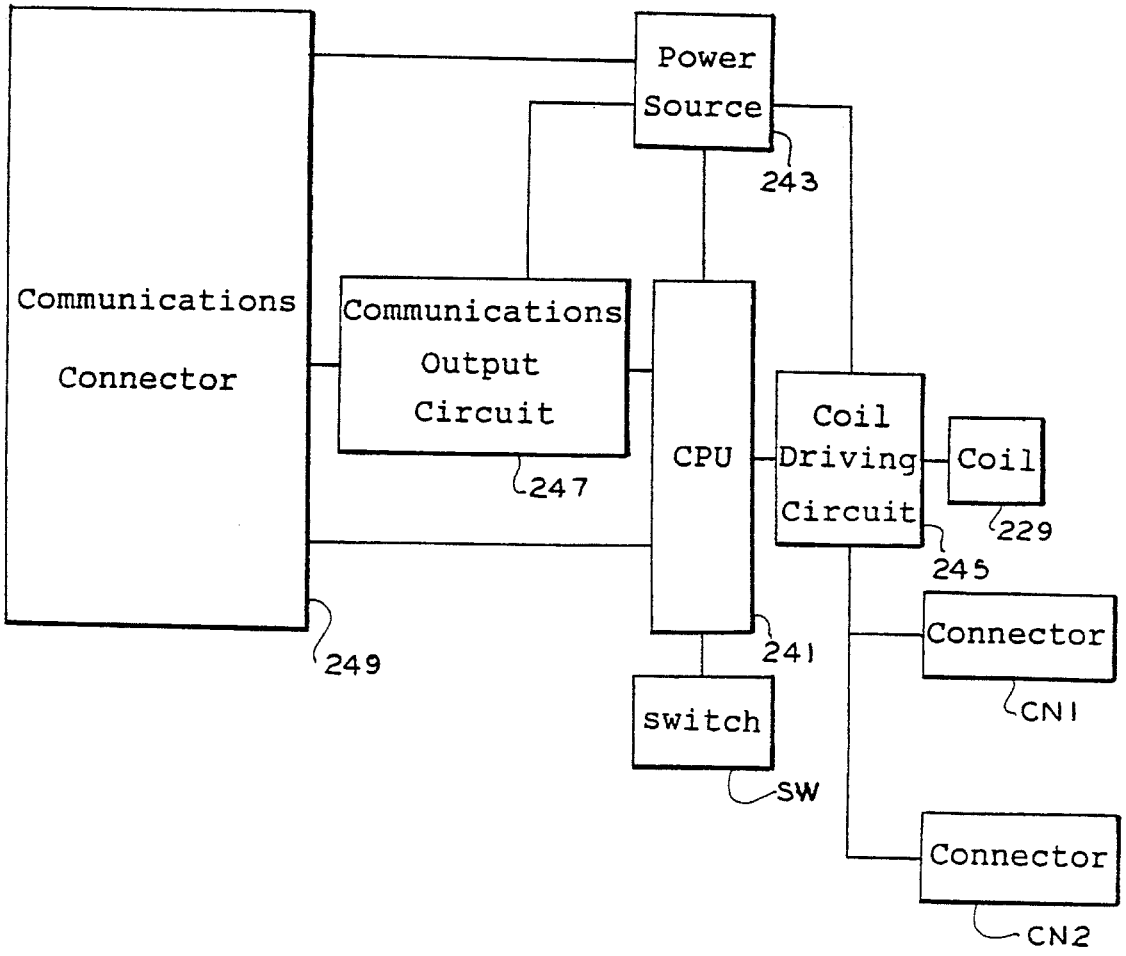
FIG. 16 is a block diagram of a toy body of a further preferred embodiment of the invention shown in FIG. 17.
Figure 17:
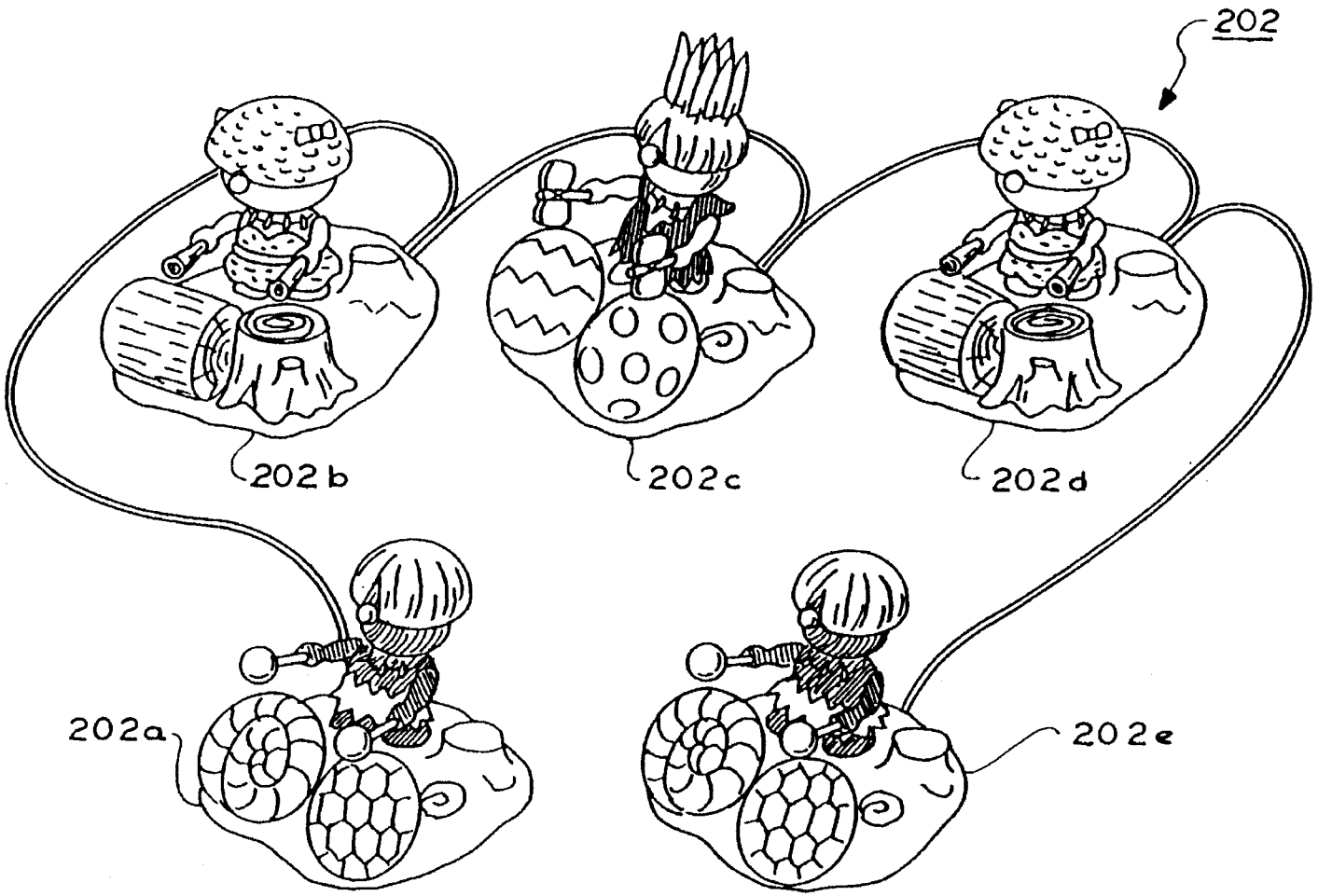
FIG. 17 is an exterior perspective overall view of a further preferred embodiment of the invention.

FIG. 16 is a block diagram showing the internal constitution of a toy body of this preferred embodiment, FIG. 17 is an exterior perspective view of a musical toy made up of a plurality of connected toy bodies, and FIG. 18 is a block diagram of the plurality of connected toy bodies.

First, the overall constitution of the embodiment will be described with reference to FIG. 17 and FIG. 18.

The musical toy 201 of this preferred embodiment is made up of a plurality of toy bodies 202*a*, 202*b*, . . . , 202*e*, and the toy bodies 202*a*, 202*b*, . . . , 202*e* are connected in a chain by signal cables. Up to a maximum of 100 toy bodies can be connected together to form the musical toy 201.

The example shown in FIG. 17 and FIG. 18 shows a case wherein a plurality of toy bodies 202*a*, 202*b*, . . . , 202*e* are connected electrically; however, the toy bodies 202*a*, 202*b*, . . . , 202*e* may alternatively be connected optically by sending and receiving for example infrared light signals using light emitting devices and light receiving devices.

Next, the toy body 202*a* will be described as a representative of the plurality of toy bodies 202*a*, 202*b*, . . . , 202*e* with reference to FIG. 19 and FIG. 20.

The toy body 202*a* is made up of a pedestal 203, a pair of sound producing bodies 205*a* and 205*b* removably mounted on the pedestal 203, and a toy body 207. The pair of sound producing bodies 205*a* and 205*b* consist of members made of synthetic resin or the like and are each formed in a suitable shape such as that of a bone, a sea shell, a turtle shell or a piece of wood. The toy body 207 consists of members made of synthetic resin or the like and is formed in the shape of a doll, and arms 209*a* and 209*b* of thereof are swingably mounted thereon. Tappers 211*a* and 211*b* are mounted on this pair of arms 209*a* and 209*b*. The pair of sound producing bodies 205*a* and 205*b* are mounted in such positions that they are struck by the pair of swinging members when they swing. As a result, when the arms 209*a* and 209*b* swing, the sound producing bodies 205*a* and 205*b* are struck by the tappers 211*a* and 211*b* mounted on the ends of the arms 209*a* and 209*b*. A head portion 213 of the toy body 207 is mounted on a torso portion 215 by way of a spring member, and the head portion 213 rocks when the arms 209*a* and 209*b* swing. Also, a cover constituting the torso portion 215 is removably mounted on the toy body 207.

Circuit boards 219*a* and 219*b* are fixed to the lower part of the toy body 207, and a case 221 consisting of members made of synthetic resin or the like is fixed to the circuit boards 219*a* and 219*b*. This case 221 is disposed in a substantially central portion of the toy body 207. A pair of permanent magnets 223 are mounted in the front-rear direction inside the case 221. A rotatable shaft 225*a* is horizontally mounted at the right side surface upper portion of the case 221, and a rotatable shaft 225*b* is similarly horizontally mounted at the left side surface upper portion of the case 221. Cases 227*a* and 227*b* consisting of members made of synthetic resin or the like are fixed to the shafts 225*a* and 225*b*, and the coils 229*a* and 229*b* are mounted in the cases 227*a* and 227*b*. The coils 229*a* and 229*b* are so disposed that they face each other with the case 221 between them. The coils 229*a* and 229*b* magnetically interact with the permanent magnets 223 mounted inside the case 221 and cause the cases 227*a* and 227*b* to swing about the shafts 225*a* and 225*b*. Terminals Pa, Pb and terminals Pc, Pd are mounted on the circuit boards 219*a* and 219*b* respectively, and the coil 229*a* is connected to the terminals Pa, Pb and the coil 229*b* is connected to the terminals Pc, Pd. These terminals Pa, Pb, Pc and Pd are electrically connected to a driving circuit which will be further discussed later. This driving circuit separately supplies drive signals to each of the coils 229*a* and 229*b* and thereby causes the cases 227*a* and 227*b* to swing independently of each other.

The arm 209*a* and the tapper 211*a* are mounted on the shaft 225*a*. A bar 231 is fixed to the other shaft 225*b* with its end pointing upward; when the shaft 225*b* rotates the bar 231 swings and the end of the bar 231 causes the head portion 213 to rock. The arm 209*b* and the tapper 211*b* are also mounted on the shaft 225*b*.

Here, the shaft 225*a* and the case 227*a*, the coil 229*a*, the arm 209*a* and the tapper 211*a* mounted on this shaft 225*a* constitute one swinging body, and similarly the shaft 225*b* and the case 227*b*, the coil 229*b*, the arm 209*b* and the tapper 211*b* mounted on this shaft 225*b* constitute another swinging body.

A pair of leg parts 233*a* and 233*b* are mounted on the bottom of the toy body 207, and the toy body 207 is fixed to the pedestal 203 by way of these leg parts 233*a* and 233*b*. Also, a pair of clip sockets 235*a* and 235*b* are provided in the torso portion 215, a pair of clip projections are provided on a back cover not shown in the drawings, and by these clip projections being clipped into these clip sockets 235*a* and 235*b* the back cover is removably fitted to the toy body 207.

Figure 21:
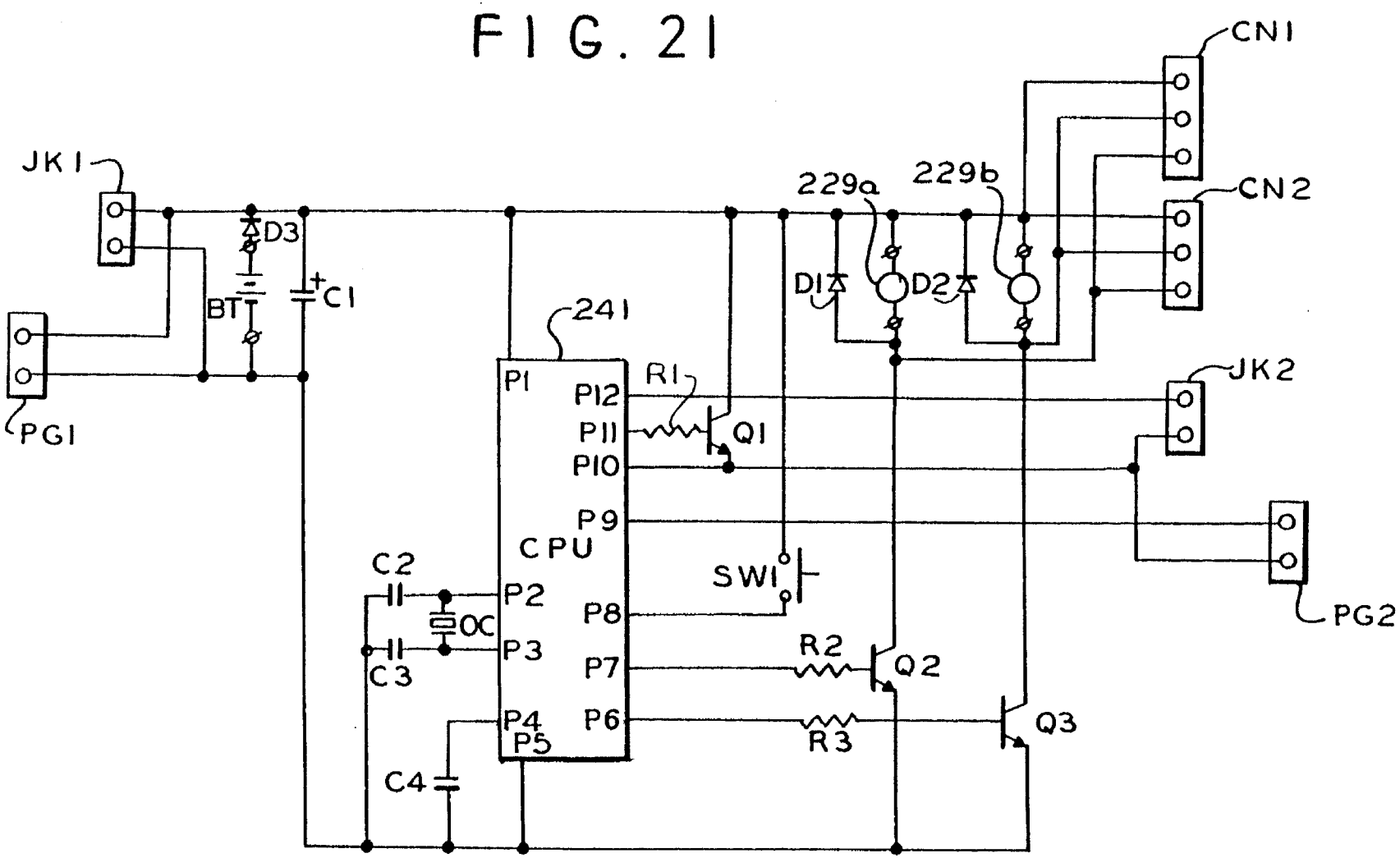
FIG. 21 is a circuit diagram of the toy body of FIG. 19.

Next, the constitution of the circuit parts built into the toy body 202*a* will be described with reference to FIG. 16 and FIG. 21.

A microcomputer (CPU) 241 has terminals P1, P2, . . . , P12, and a power supply 243 is connected to the terminals P1 and P5. The power supply 243 is made up of a battery BT, a diode D3 for preventing battery charging, and a capacitor C1. The power supply 243 is connected to a female jack JK1 and a male plug PG1. Because the toy body is connected to the other toy bodies through the jack JK1 and the plug PG1, even if one of the toy bodies has no battery BT in it, that toy body can still operate. Also, when the toy body does have a battery BT in it, the presence of the diode D3 prevents the battery BT from being charged.

The CPU 241 is connected to a switch SW, a coil driving circuit 245 and a communication output circuit 247. The CPU 241 has principal operating means for principally operating the toy when the switch SW, which is switching means, is operated; this principal operating means has starting signal outputting means for outputting a starting signal, tapping signal outputting means for outputting a tapping signal consisting of a plurality of parts, and assignment signal outputting means for outputting an assignment signal assigning tapping signals of the parts to respective toy bodies.

That is, when the switch SW is operated, a starting signal and a tapping signal of the kind shown in FIG. 22(A) are outputted through the terminal P10 and a jack JK2 and a plug PG2. At this time, a mode signal is outputted through the terminal P9 and the plug PG2 and through the terminal P12 and the jack JK2 with the timing shown in FIG. 22(B).

The above-mentioned starting signal consists of a positive pulse of pulse width T1 (for example 1337 microseconds) as shown in FIG. 22(A), and the tapping signal is outputted after a predetermined waiting time T2 (for example 1 second) for a period T3 (for example 13 milliseconds) and this tapping signal is outputted repeatedly with a period T4 (for example 125 milliseconds).

This repeatedly outputted tapping signal consists of a 1-bit start signal followed by a 12-bit strike signal, and the period T5 of each bit is set to for example 1020 microseconds. In a solo continuous mode wherein the plurality of toy bodies 202*a*, 202*b*, . . . , 202*e* continuously perform a solo tune at the same time, the first and second bits of the strike signal are set as coil driving signals. For example, the first bit of the drive signal is used as a coil driving signal of the coil 229*a* which drives the right arm 209*a* and the second bit of the strike signal is used as the driving signal of the coil 229*b* which drives the left arm 209*b*. In a session mode wherein the plurality of toy bodies are divided into a part No. 1 group and a part No. 2 group and the part No. 1 group are made to perform a session tune of a part No. 1 and the part No. 2 group are made to perform a session tune of a part No. 2, the first bit and the second bit of the strike signal are set as the coil driving signals of the part No. 1 group and the third and fourth bits of the driving signal are set as the coil driving signals of the part No. 2 group. Modes wherein the toy is made to perform a session tune of three or more parts can also be similarly set.

As shown in FIG. 24, the above-mentioned mode signal is a four bit signal; each bit of logic value '0' consists of a positive pulse of pulse width T6 (for example 668 microseconds) and a negative pulse of pulse width T7 (for example 510 microseconds), and each bit of logic value '1' consists of a positive pulse of pulse width T8 (for example 1337 microseconds) and a negative pulse of pulse width T9 (for example 510 microseconds). Suitable modes such as the solo continuous mode and the session mode are set by means of a four bit mode signal consisting of a suitable combination of the above-mentioned bits of logic value '0' and '1'. The mode signal which sets the session mode functions as an assignment signal for assigning the tapping signals of the parts to respective toy bodies.

Referring again to FIG. 16 and FIG. 21, the CPU 241 has subordinate operating means for subordinately operating when an inputting of the above-mentioned starting signal is detected, and this subordinate operating means has a driving signal supplying means which when the above-mentioned tapping signal consisting of a plurality of parts is inputted detects the tapping signal of the part assigned to that toy body by the above-mentioned assigning signal and supplies the tapping signal of this assigned part to the coil.

The coil driving circuit 245 is made up of resistors R2 and R3 and transistors Q2 and Q3. Driving signals from this coil driving circuit 245 are outputted to a coil circuit 229. The coil circuit 229 is made up of diodes D1 and D2 for preventing countercurrent and the coils 229*a* and 229*b*. The coil driving circuit 245 is connected to connectors CN1 and CN2, and the driving signals are outputted through the connectors CN1 and CN2. The communication output circuit 247 is made up of a resistor R1 and a transistor Q1. This communication output circuit 247 is connected to a communication connector 249. The communication connector 249 comprises the female jacks JK1 and JK2 and the male plugs PG1 and PG2. The female jacks JK1 and JK2 are formed integrally with each other and are mounted in the back of the toy body 202*a*. The male plugs PG1 and PG2 are also formed integrally with each other and are mounted at the end of a signal cable leading from the back of the toy body 202*a*. Two toy bodies are connected together by the plugs PG1 and PG2 of one toy body being plugged into the jacks JK1 and JK2 of this other toy body. Similarly, by the plugs PG1 and PG2 of the other toy body being plugged into the jacks JK1 and JK2 of the next toy body, the plurality of toy bodies are linked together one after another in a chain.

An oscillator OC and capacitors C2 and C3 are connected to the terminals P2 and P3 of the CPU 241, and a capacitor C4 is connected to the terminal P4. The CPU 241 has a memory, and a plurality of types of tune data used in the solo continuous mode and the session mode etc are stored in this memory. The tune data stored in this memory is suitably read out according to the set mode.

The other toy bodies 202*b*, 202*c*, . . . , 202*e* have the same constitution as the toy body 202*a* described above, and a detailed description thereof will therefore be omitted.

Next, the operation of the preferred embodiment shown in FIG. 16 to FIG. 21 will be explained.

Figure 25:
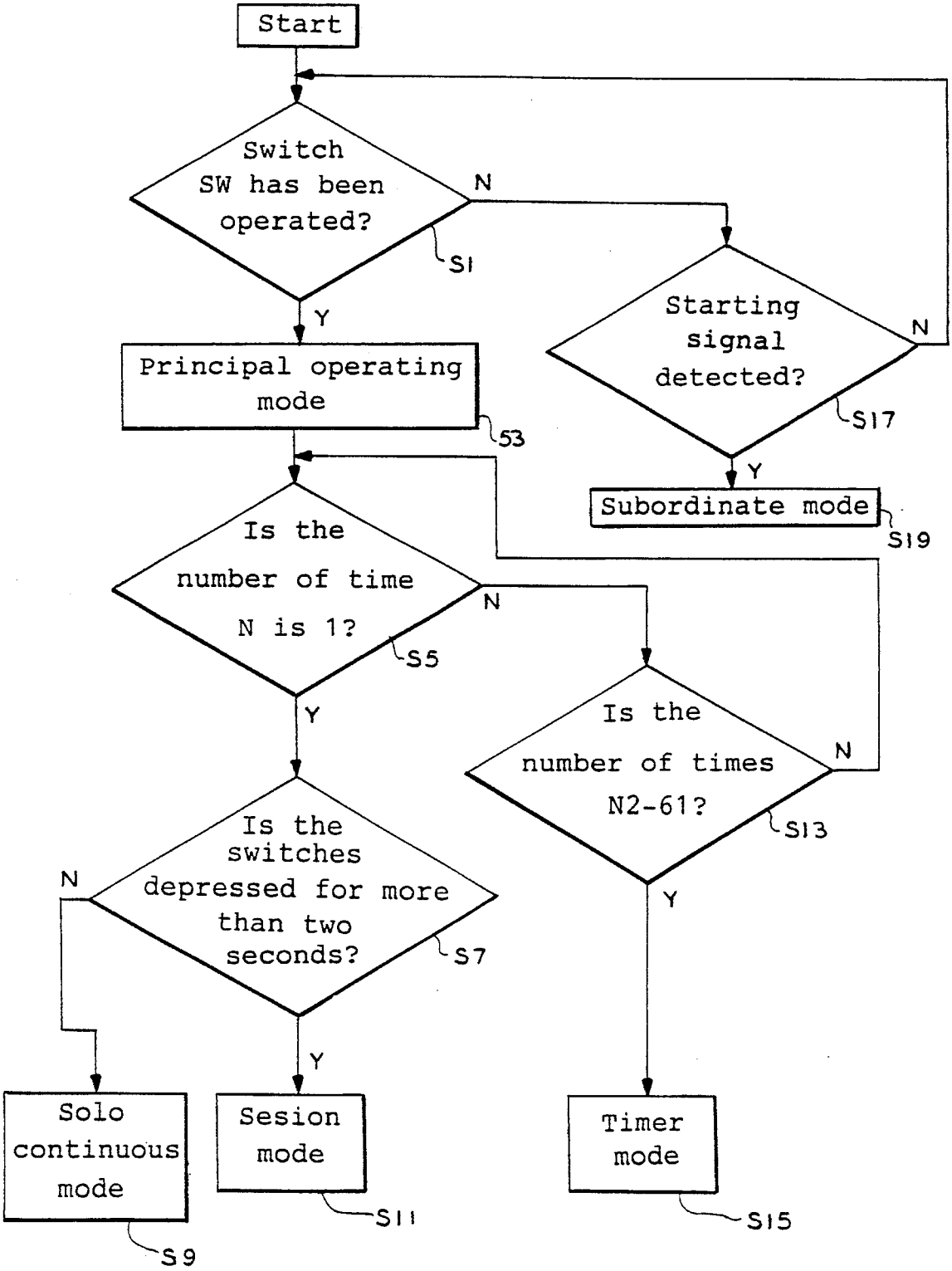
FIG. 25 is a flow chart showing the basic operation of the musical toy of the preferred embodiment of FIG. 17.

In step S1, shown in FIG. 25, it is judged whether or not the switch SW has been operated, and for example when the switch SW of the toy body 202*c* has been operated, processing proceeds to step S3 and the toy body 202*c* is set to the principal operating mode. When the switch SW is operated once only and is depressed for less than two seconds, processing moves through steps S5 and S7 to step S9, and the solo continuous mode is set. When the number of times N the switch SW is operated is 1 and the switch SW is depressed for more than two seconds, processing moves through steps S5 and S7 to step S11 and the session mode is set. When the number of times N the switch SW is operated is two or more, processing moves from step S5 through step S13 to step S15, and a timer mode is set. When the switch SW is not operated but a starting signal from another toy body is detected, for example when the toy body 202*d* receives a starting signal from the toy body 202*c*, processing moves through step S1 and step S17 to step S19 and the toy body 202*d* is set to the subordinate mode.

Figure 26:
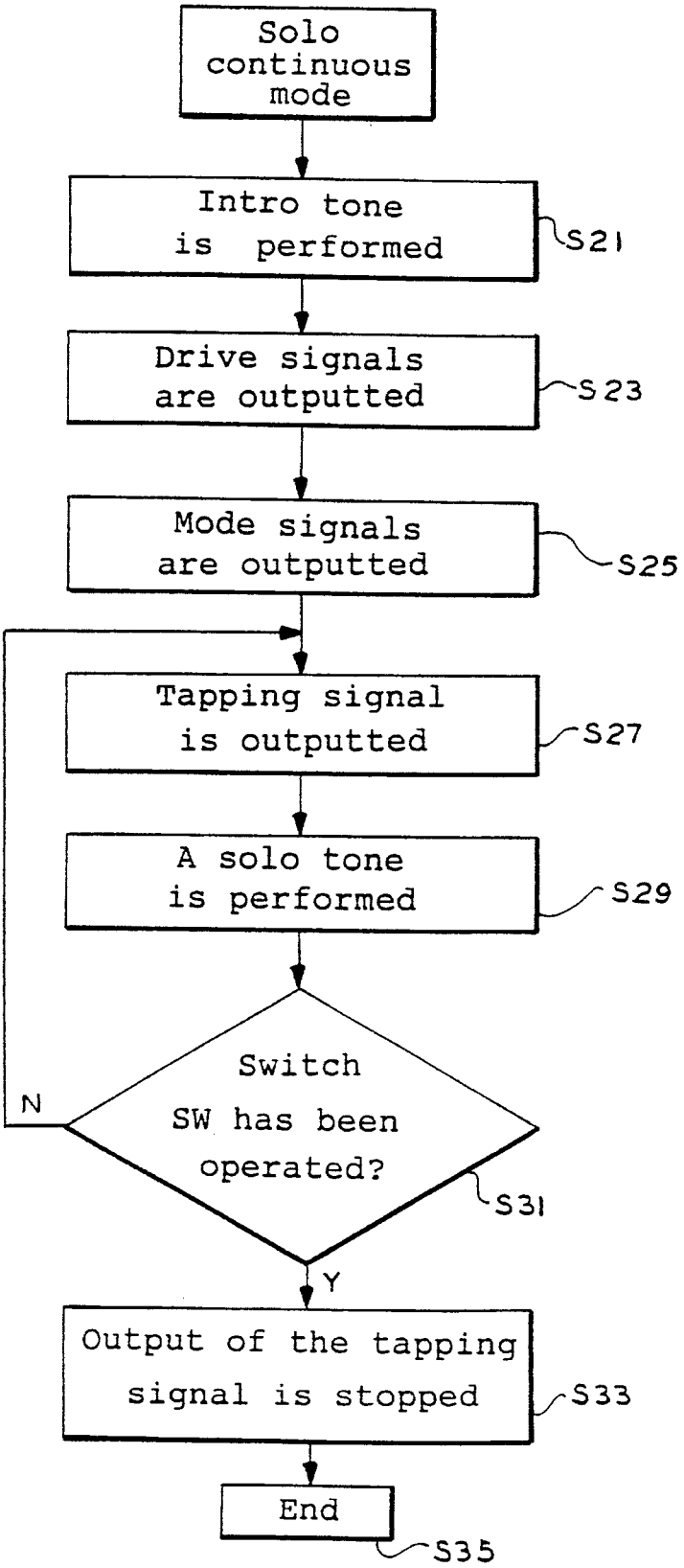
FIG. 26 is a flow chart showing principal operation in a solo continuous mode of the preferred embodiment of FIG. 17.

Next, operation in the solo continuous mode will be described with reference to FIG. 26.

In step S21 an intro tune is performed for a predetermined time. In step S23, a starting signal is outputted from the toy body 202*c* to all the other toy bodies. In step S25 the mode signal of the solo continuous mode is outputted to the adjacent toy bodies 202*b* and 202*d*. In step S27 a tapping signal of a solo tune is outputted to all the other toy bodies. In step S29, drive signals are outputted to the coils 229*a* and 229*b* based on the above-mentioned tapping signal, and the magnetic interaction between the coils 229*a* and 229*b* and the permanent magnets 223 causes the tappers 211*a* and 211*b* to strike the sound producing bodies 205*a* and 205*b* and produce sounds. In this way the toy body 202*c* itself, performing principal operation, performs a solo tune. At this time, all the other toy bodies, performing subordinate operation, also perform the same solo tune, as will be discussed in further detail later. In step S31, it is judged whether or not the switch SW has been operated again, and if the switch SW has not been operated again processing returns to step S27 and the performance of the above-mentioned solo tune continues. If in step S31 it is judged that the switch SW has been operated, processing proceeds to steps S33 and S35, the output of the tapping signal is stopped and solo continuous mode operation is ended.

Because one toy body operates principally and the other toy bodies are made to operate subordinately in this way, the plurality of toy bodies can be made to operate in precise synchrony and the entertainment of a synchronized performance can be realized.

Figure 27:
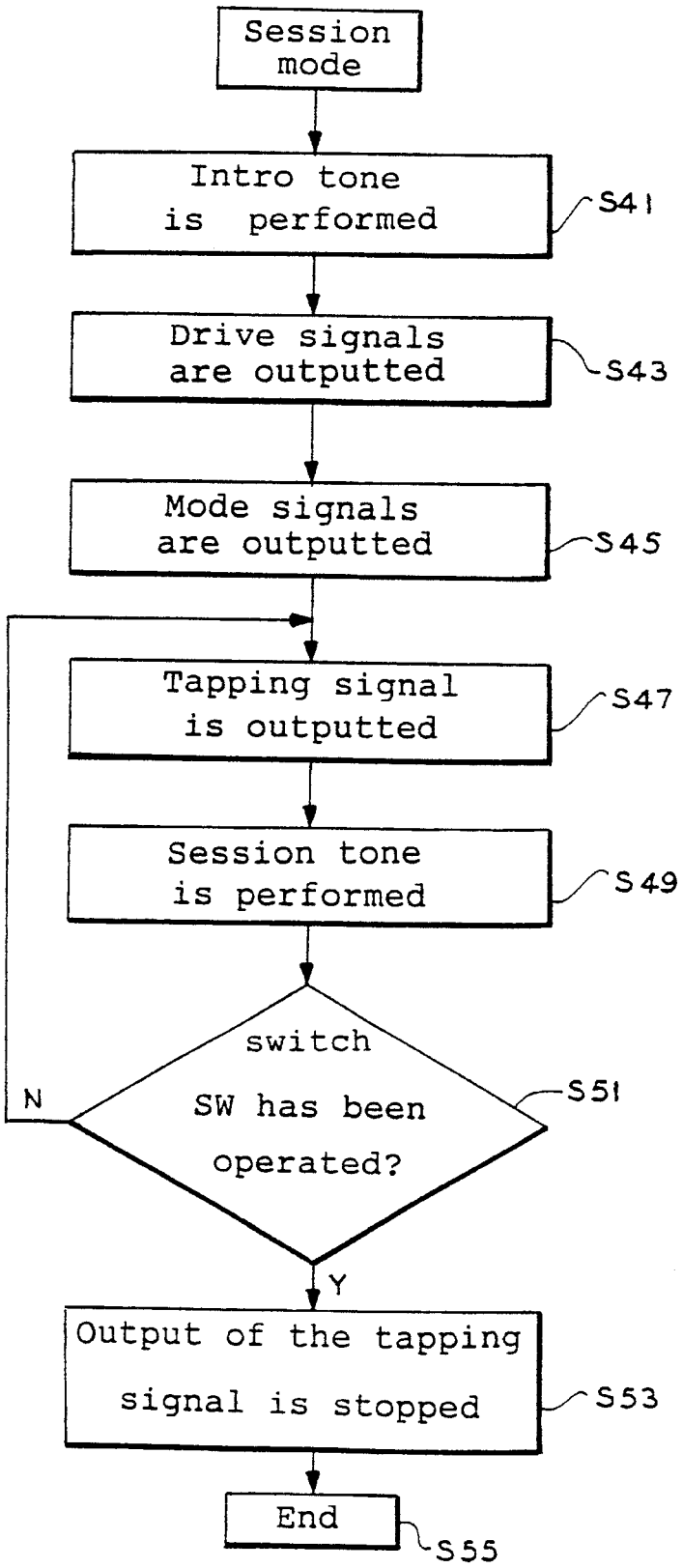
FIG. 27 is a flow chart showing operation in a session mode of the preferred embodiment of FIG. 17.

Next, operation in the session mode will be described with reference to FIG. 27.

In step S41 an intro tune is performed for a predetermined time. In step S43 a starting signal is outputted from the toy body 202*c* to all the other toy bodies. In step S45 a session mode mode signal is outputted to the adjacent toy bodies 202*b* and 202*d*. In step S47 a tapping signal consisting of a plurality of parts is outputted to all the other toy bodies. In step S49, driving signals are outputted to the coils 229*a* and 229*b* based on the above-mentioned tapping signal, and the magnetic interaction between the coils 229*a* and 229*b* and the permanent magnets 223 causes the tappers 211*a* and 211*b* to strike the sound producing bodies 205*a* and 205*b* and produce sounds. Thus the toy body 202*c* itself, performing principal operation, performs the session tune of part No. 1. At this time, of the other toy bodies those in the No. 1 group perform the session tune of part No. 1 and those in the No. 2 group perform the session tune of part No. 2. In step S51 it is judged whether or not the switch SW has been opera-ted again, and when the switch SW has not been operated again processing returns to step S47 and the performance of the session tune continues. When in step S51 it is judged that the switch SW has been operated again, processing proceeds to steps S53 and S55, output of the tapping signal is stopped and session mode operation is ended.

Figure 28:
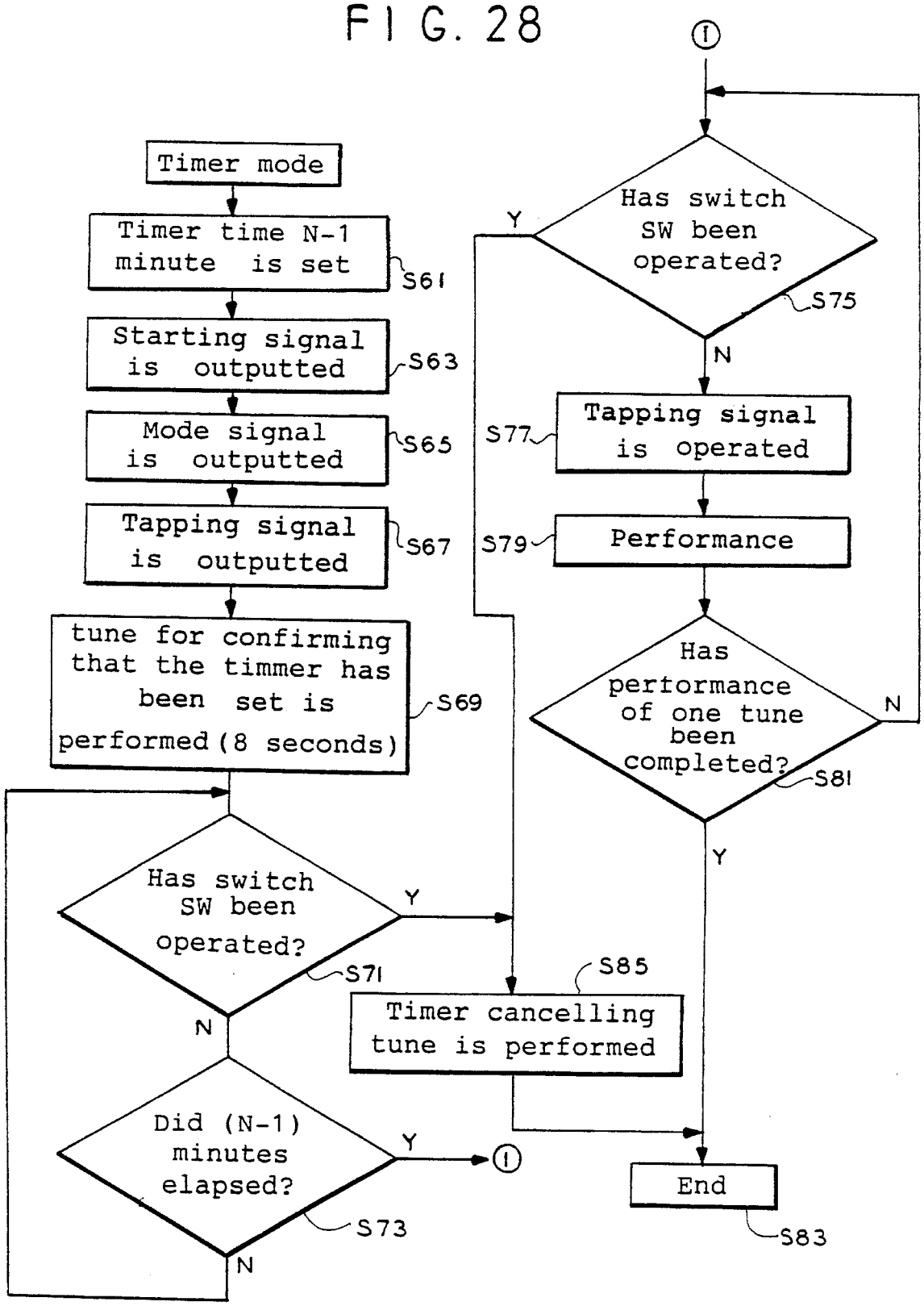
FIG. 28 is a flow chart showing operation in a timer mode of the preferred embodiment of FIG. 17.

Next, operation in the timer mode will be described with reference to FIG. 28.

In step S61, according to the number of times N the switch SW is operated, a timer time (N–1) minutes is set. In step S63 a starting signal is outputted, and in step S65 a mode signal is outputted. In step S67 a tapping signal is outputted, and in step S69 a tune for confirming that the timer has been set is performed for example for 8 seconds. At the same time as this timer setting confirmation tune is performed, or when the performance finishes, timer operation is started. Musical performance operation is stopped for the duration of this timer operation. If during timer operation the switch SW is operated, processing proceeds from step S71 to step S85, a timer canceling tune is performed for a predetermined time and timer operation is ended (step S83). When the set timer time elapses without the switch SW being operated, processing proceeds from steps S71 and S73 to steps S75 and S77. In steps S77 and S79, a tapping signal is outputted and the toy performs based on this tapping signal. In this way the toy makes it known that the set timer time has elapsed. In step S81 it is judged whether or not the performance of one tune has been completed. When the switch SW is operated during the performance, processing proceeds from step S75 to step S85, a timer cancelling tune is performed for a predetermined time and operation is ended (step 83). When in step S81 it is judged that the performance of one tune has been completed, processing proceeds to step S83 and timer mode operation is ended.

Next, subordinate mode operation will be described with reference to FIG. 29 through FIG. 32.

When for example the toy body 202*d* receives a mode signal from the toy body 202*c* (step S87), the received mode signal is analyzed and it is judged whether or not it is that of the solo continuous mode (steps S89 and S91). When it is judged to be the mode signal of the solo continuous mode, processing moves from step S91 to step S93 and the solo continuous mode signal is passed on to the next toy body 202*e*. Processing then proceeds from step S93 to step S95 shown in FIG. 30 and it is judged whether or not a tapping signal has been received from the toy body 202*c*. When a tapping signal has been received, processing proceeds from step S95 to step S97 and the received tapping signal is analyzed. In step S99, a solo tune is continuously performed based on the tapping signal. Here, when the tapping signal from the toy body 202*c* performing principal operation is not received for more than a predetermined time, processing proceeds from steps S95 and S101 to step S103 and subordinate operation of the toy body 202*d* is stopped.

Figure 29:
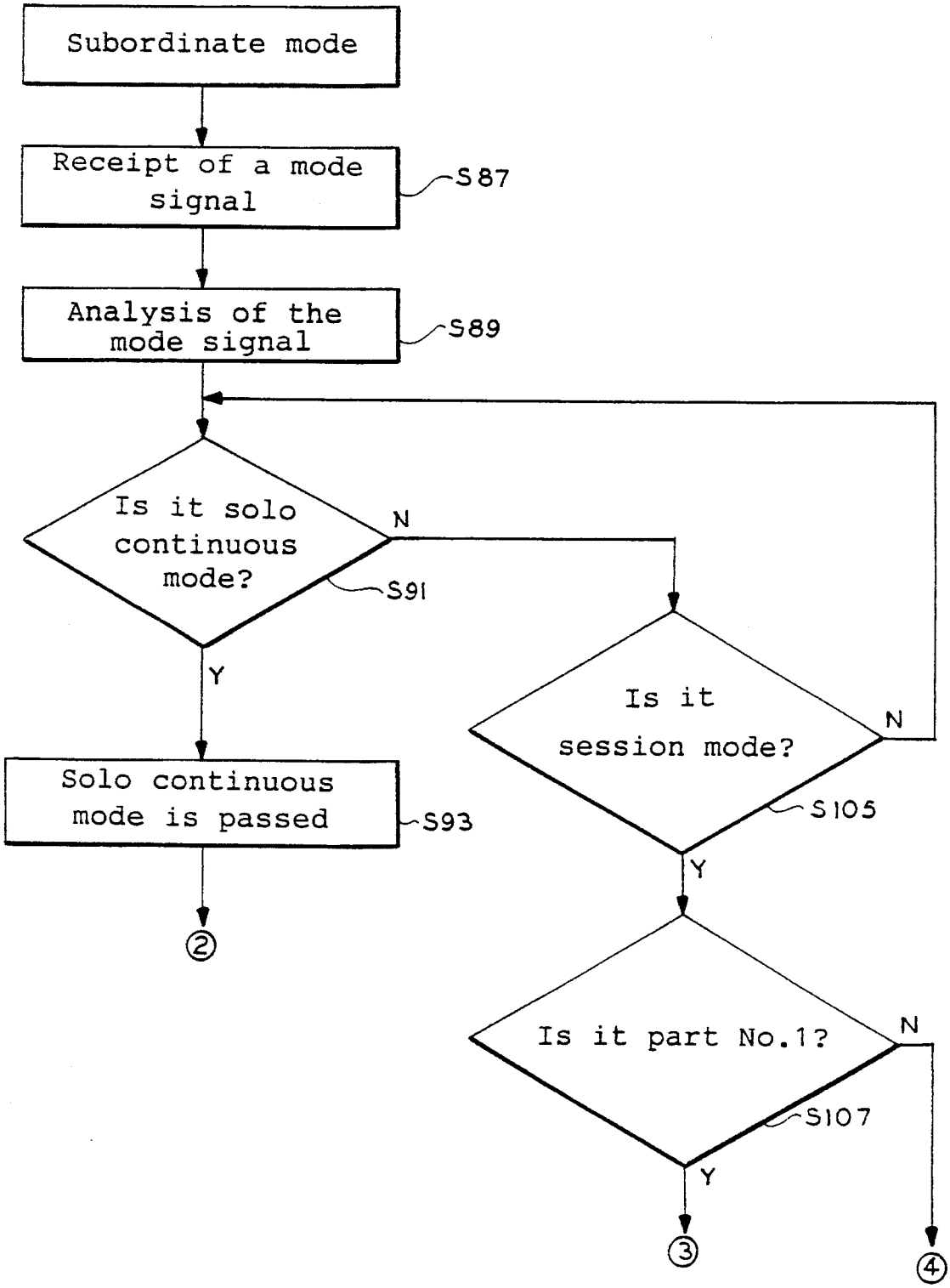
FIG. 29 is a flow chart showing operation in a subordinate mode of the preferred embodiment of FIG. 17.
Figure 30:
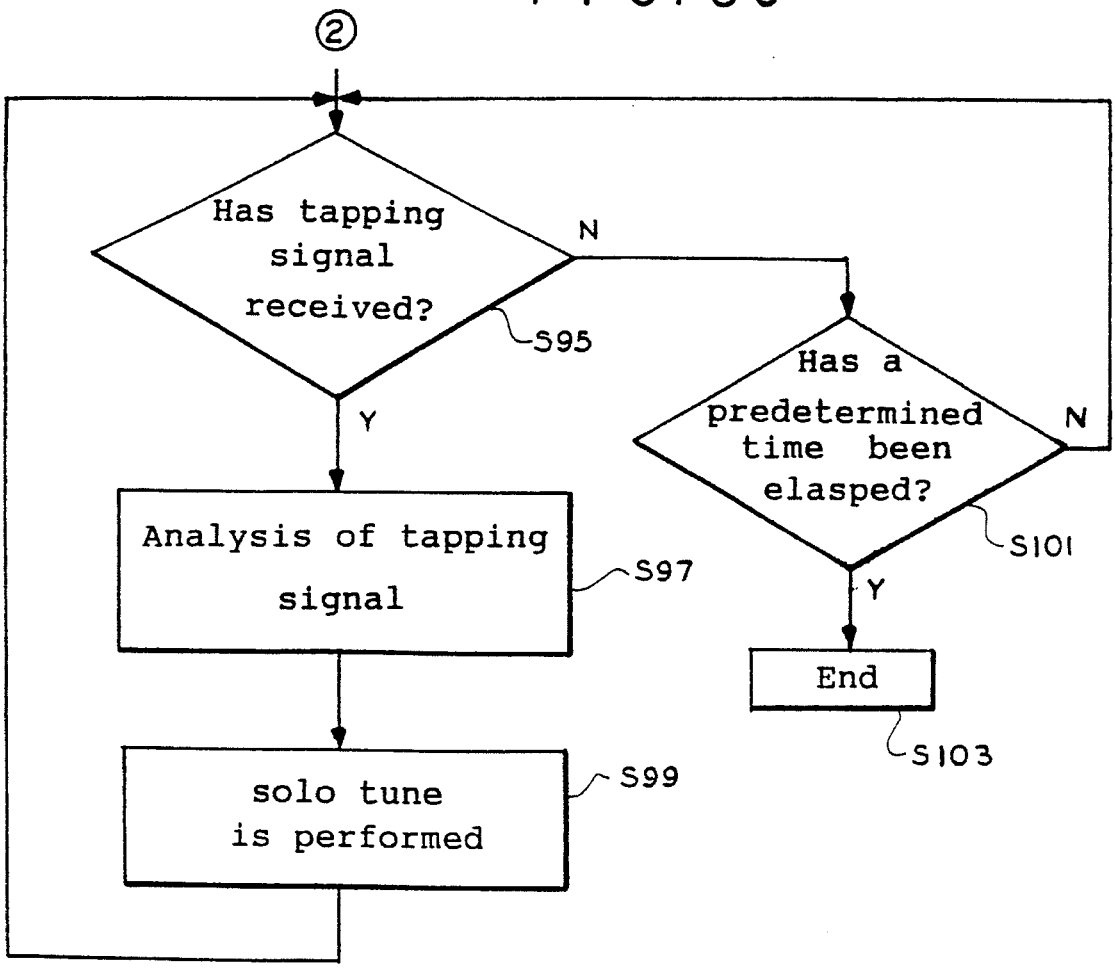
FIG. 30 is a flow chart showing subordinate operation in the solo continuous mode of the preferred embodiment of FIG. 17.

When in step S91 shown in FIG. 29 the mode signal is judged not to be that of the solo continuous mode, processing proceeds from step S91 to step S105 and judges whether or not it is that of the session mode. When it is judged to be that of the session mode, processing further proceeds to step S107 and judges whether or not it is the session mode of part No. 1. When it is judged to be the session mode of part No. 1, processing proceeds from step S107 to step S111 shown in FIG. 31.

Figure 31:
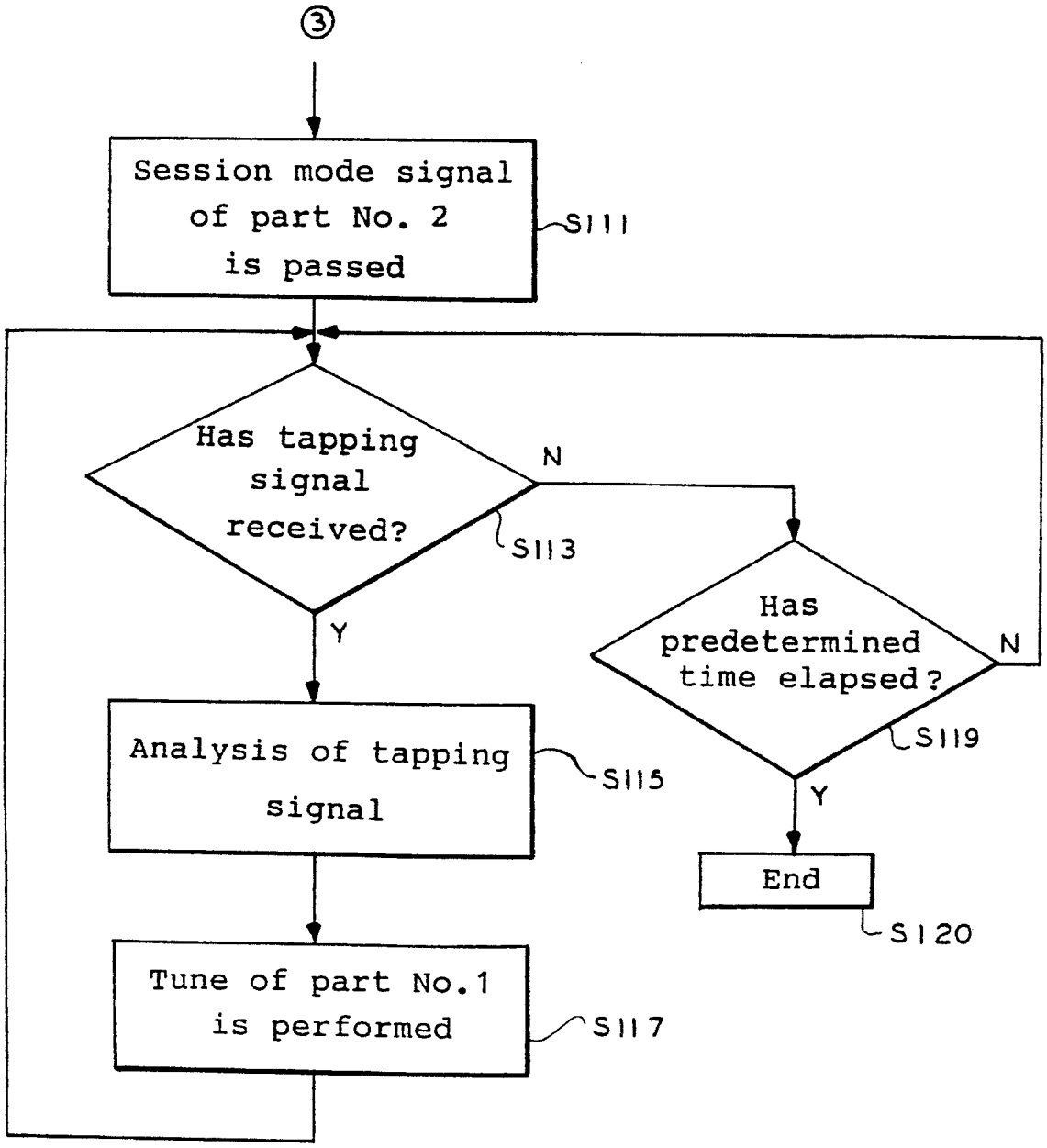
FIG. 31 is a flow chart showing operation in the session mode of a part No. 1 of the preferred embodiment of FIG. 17.

In step S111 shown in FIG. 31, the session mode signal of part No. 2 is passed on to the next toy body 202*e*. In step S113 it is judged whether or not a tapping signal has been received from the toy body 202*c*, and when a tapping signal has been received processing proceeds from step S113 to step S115 and the received tapping signal is analyzed. In step S117, the session tune of part No. 1 is continuously performed based on the tapping signal. When here the tapping signal from the toy body 202*c* performing principal operation is not received for more than a predetermined time, processing proceeds from steps S113 and S119 to step S120 and subordinate operation of the toy body 202*d* is ended.

Figure 32:
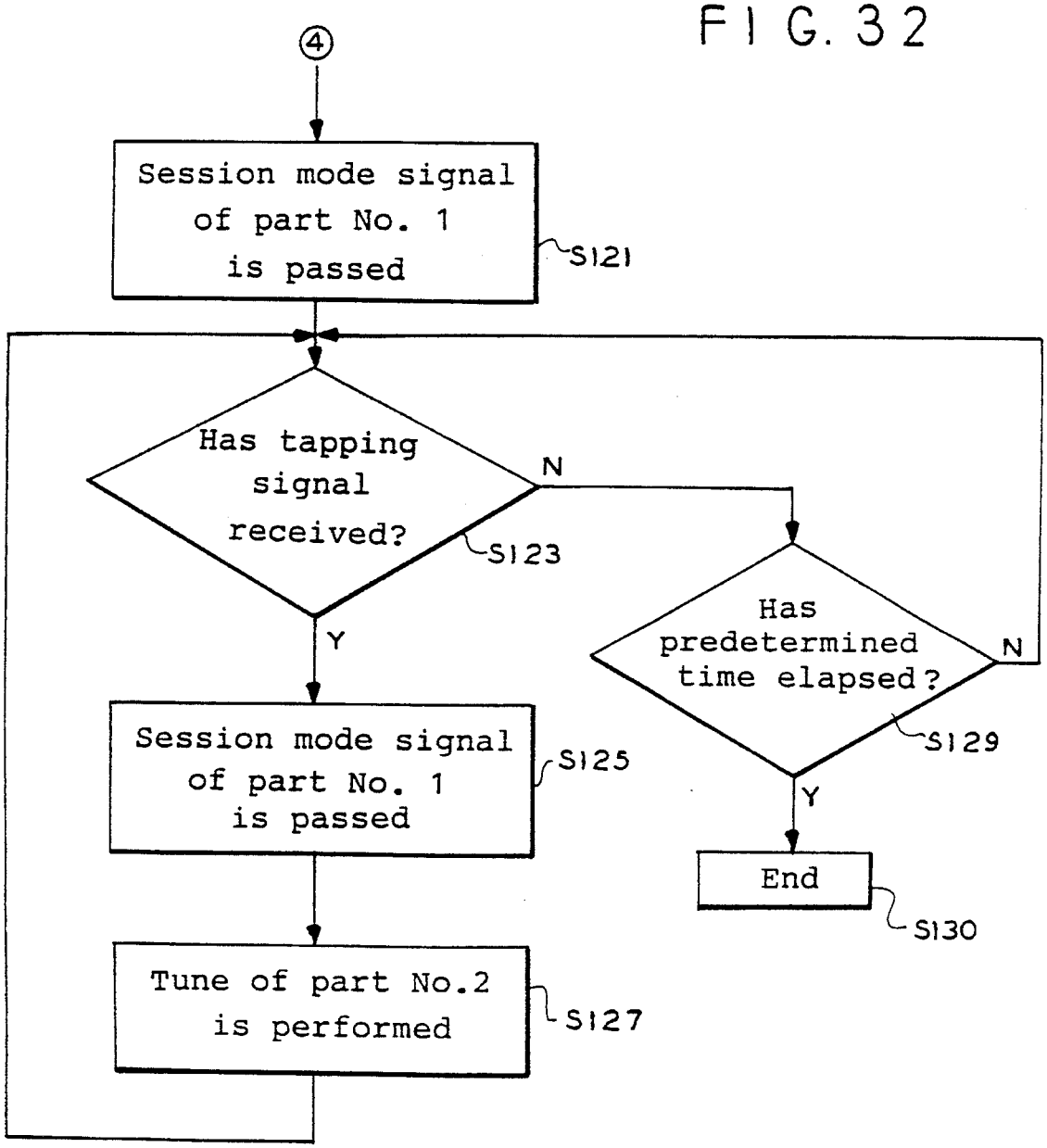
FIG. 32 is a flow chart showing operation in the session mode of a part No. 2 of the preferred embodiment of FIG. 17.
Figure 33:
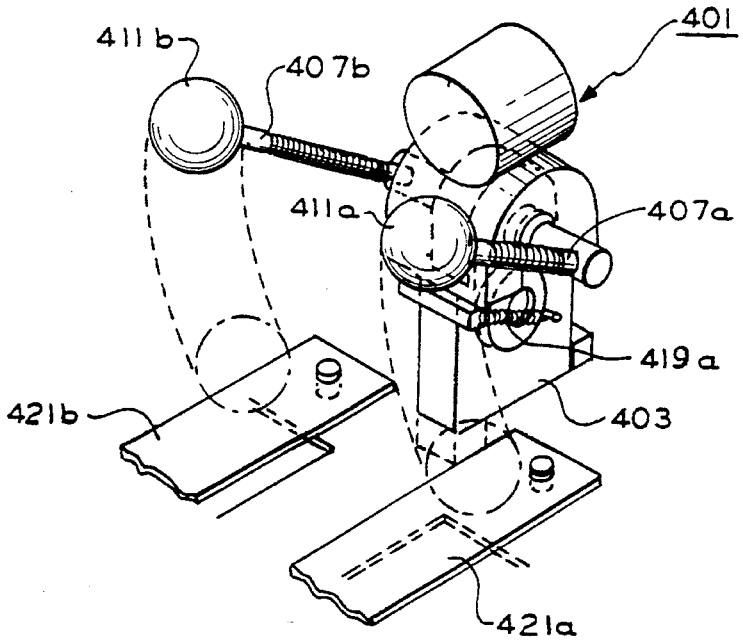
FIG. 33 is an exterior perspective view of a conventional musical toy.
Figure 34:
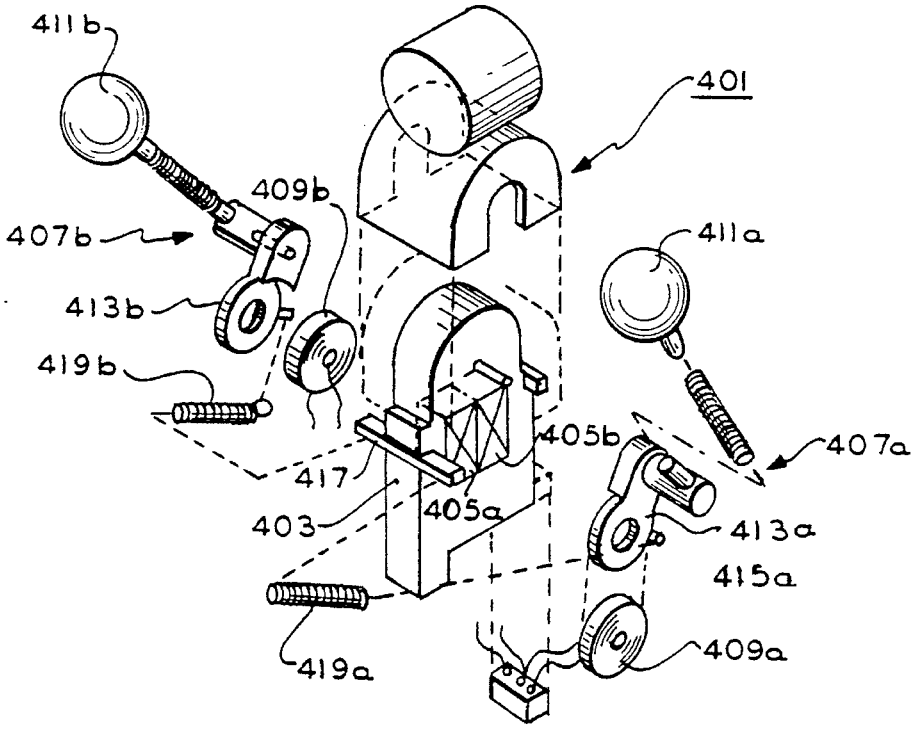
FIG. 34 is an exploded perspective view of the conventional musical toy of FIG. 33.

When in step S107 shown in FIG. 29 it is judged that the mode signal is not that of the part No. 1 session mode, processing proceeds from step S107 to step S121 shown in FIG. 32.

In step S121 shown in FIG. 32 the session mode signal of part No. 1 is passed on to the next toy body 202*e*. In step S123 it is judged whether or not a tapping signal has been received from the toy body 202*c*, and when a tapping signal has been received processing proceeds from step S123 to step S125 and the received tapping signal is analyzed. In step S127 the session tune of part No. 2 is continuously performed based on this tapping signal. When here the tapping signal is not received from the toy body 202*c* performing principal operation for more than a predetermined time, processing proceeds from steps S123 and S129 to step S130 and subordinate operation of the toy body 202*d* is ended.

Because as described above the toy body operating principally outputs to the other toy bodies a starting signal, a tapping signal consisting of a plurality of parts, and an assigning signal which assigns the tapping signal of the parts to the respective toy bodies, and when they detect the inputting of the starting signal the other toy bodies operate subordinately and their swinging bodies swing based on the tapping signals of the parts assigned to them from the tapping signal consisting of the plurality of parts, it is possible for the rhythms and tempos performed to be varied and sounds can be produced with more complex and delicate rhythms and tempos.

Also, because the plurality of toy bodies operating subordinately perform different parts alternating in the order in which they are connected, the performance is made even more entertaining.

In the example described above the toy body 202*c* operates principally and the other toy bodies operate subordinately; however, the overall operation of the toy as described above is the same whichever of the toy bodies it is whose switch is depressed. That is, the toy body whose switch is depressed operates principally and the other toy bodies operate subordinately.

Also, it is possible to connect a toy body having a person detector to the above-mentioned toy bodies 202*a*, 202*b*, . . . ,202*e*. That is, instead of the switch SW, a light sensor can be used and the plurality of toy bodies 202*a*, 202*b*, . . . , 202*e* can be made to operate when the presence of a person is detected optically.

When the plurality of toy bodies 202*a*, 202*b*, . . . , 202*e* are made to operate when the presence of a person is detected optically in this way, the operation of the toy bodies is surprising and the toy is even more interesting.

Also, it is possible to connect a toy body for melody performance to the toy bodies 202*a*, 202*b*, . . . , 202*e*. In this case, the sound producing bodies 205*a* and 205*b* mounted on the toy bodies 202*a*, 202*b*, . . . , 202*e* are exchanged and so replaced that the sounds of a musical scale 'do', 'ray', 'me' can be produced. The toy body for melody performance has a memory in which melody data for a number of different melodies are stored, outputs a tapping signal based on data read out from this memory, and assigns musical note data to toy bodies set to the respective musical notes. Because the respective toy bodies sequentially produce sounds of the musical notes assigned to them, the toy can be made to perform specific melodies.

Also in the case wherein a toy body for melody performance is connected as described above, because the swinging bodies are caused to swing by the magnetic interaction between permanent magnets and coils, there is no extraneous mechanical noise and melody sounds can be produced faithfully in accordance with delicate melodies.

Furthermore, because the swinging bodies are caused to swing only by the magnetic interaction between permanent magnets and coils, and no motors or mechanical drive transmission mechanisms are used, the assembly of the toy is easy and the overall toy can be made small.

In the preferred embodiment described above, two permanent magnets were disposed in the front-rear direction in the toy body 207; however, a single permanent magnet may alternatively be used. In this case the magnetic poles of the permanent magnet should be arrayed in the front-rear direction and the magnetic poles formed at the sides of each of the coils 229*a* and 229*b* should be suitably set by suitably controlling the direction of the flow of current through the coils 229*a* and 229*b*.

As described above, according to the first means of this invention, there are provided a toy body, a sound producing body and a control device; the toy body comprises a first permanent magnet and a swinging body, and this swinging body comprises a tapper for striking the sound producing body and an acting part for magnetically interacting with the first permanent magnet and generating a swinging force. The acting part comprises a second permanent magnet for swinging the tapper up and a coil for swinging down the upswung tapper, and when rhythm signal generating means provided in the control device supplies a rhythm signal to the coil, the swinging body swings and causes the tapper to strike the sound producing body according to the rhythm signal.

By providing a second permanent magnet in this way, the effect is obtained that it is possible to realize a musical toy in which the tapper on the end of the swinging body can be swung up and kept upswung without using any springs; space for spring mounting is thereby made unnecessary and the toy can be made small; the manufacturing process can be simplified and resulting mass production benefits and cost reductions can be achieved, and which can operate stably over a long period of time.

Also, because the sound producing body is struck by a tapper on the end of a swinging body swinging in accordance with a rhythm signal, the effect is obtained that the toy can be made to produce specific rhythm sounds and can thereby be made entertaining.

According to the second means of this invention, there are provided a plurality of toy bodies, a plurality of sound producing bodies disposed in correspondence with a plurality of musical notes, and a control device; each of the toy bodies has a first permanent magnet and a swinging body, and the swinging bodies of the toy bodies are severally mounted in correspondence with the plurality of musical notes. Each of the swinging bodies comprises a tapper for striking the sound producing body of the corresponding musical note and an acting part for magnetically interacting with the respective first permanent magnet and generating a swinging force; each of the acting parts comprises a second permanent magnet for swinging the respective tapper up and a coil for swinging down the respective upswung tapper; and when melody signal generating means provided in the control device supplies a melody signal to the coils the swinging bodies swing and cause the tappers to strike the corresponding sound producing bodies according to the melody signal.

By providing second permanent magnets in this way the effect is obtained that it is possible to realize a musical toy in which the tappers on the ends of the swinging bodies can be swung up and kept in an initial upswung state without using any springs; space for spring mounting is thereby made unnecessary and the toy can be made small; the manufacturing process can be simplified and resulting mass production benefits and cost reductions can be achieved, and which can operate stably over a long period of time.

Also, because the sound producing bodies are struck by tappers on the ends of swinging bodies swinging in accordance with a melody signal, the effect is obtained that the toy can be made to produce specific melody sounds and can thereby be made entertaining.

According to the third means of the invention, a coil is fixed inside a toy body, a permanent magnet is mounted on the base portion of an arm mounted on one side of the toy body, and the arm is free to be horizontally pivoted by a magnetic interaction force acting between this permanent magnet and the coil. A control device comprises rhythm signal generating means for generating a rhythm signal, and when by supplying this rhythm signal to the coil the control device causes the arm to horizontally pivot according to the rhythm signal, a tapper mounted on the end of this horizontally pivoting arm strikes a sound producing body and produces a rhythm sound. Also, a magnetic body is disposed in such a position that it magnetically interacts with the permanent magnet and forcibly causes the arm to pivot to an initial position.

By providing the magnetic body in this way the effect is obtained that it is possible to realize a musical toy in which the arm can be caused to pivot to an initial position without using any springs; space for spring mounting is thereby made unnecessary and the toy can be made small; the manufacturing process can be simplified and resulting mass production benefits and cost reductions can be achieved, and which can operate stably over a long period of time.

Also, because the arm is horizontally pivoted in accordance with a rhythm signal, the effect is obtained that the tapper mounted on the end of this arm can be made to strike a sound producing body and produce specific rhythm sounds and the toy can thereby be made entertaining.

According to the fourth means of this invention, a coil is fixed inside a toy body, a permanent magnet is mounted on the base portion of a first arm mounted on one side of the toy body, and the first arm is free to be horizontally pivoted by a magnetic interaction force acting between this permanent magnet and the coil. Also, on the other side of the toy body a second arm is linked to the base portion of the first arm and is caused to horizontally pivot in conjunction with the first arm. A control device comprises rhythm signal generating means for generating a rhythm signal and by supplying this rhythm signal to the coil causes the first and second arms to horizontally pivot according to the rhythm signal. At this time, the pair of arms move in a hand-clapping action and sound producing bodies mounted on the ends of the arms are clapped together and produce a rhythm sound. Also, there is provided a magnetic body disposed in such a position that it magnetically interacts with the permanent magnet and forcibly causes the pair of arms to pivot to an initial position.

By providing the magnetic body in this way the effect is obtained that it is possible to realize a musical toy in which the pair of arms can be caused to pivot to an initial position without using any springs; space for spring mounting is thereby made unnecessary and the toy can be made small; the manufacturing process can be simplified and resulting mass production benefits and cost reductions can be achieved, and which can operate stably over a long period of time.

Also, because the pair of arms are horizontally pivoted in accordance with a rhythm signal, the effect is obtained that the toy can be made to the clap together the tappers mounted on the ends of the arms and produce specific rhythm sounds, and can thereby be made entertaining.

According to the fifth means of the invention, there are provided a plurality of electrically or optically connected toy bodies; each of the toy bodies comprises a permanent magnet and a swinging body swingably mounted in the vicinity of the permanent magnet; the swinging body is provided with a coil for magnetically interacting with the permanent magnet and causing the swinging body to swing; and there are provided sound producing bodies disposed in such positions that they are struck by the swinging bodies. When drive signals are supplied to the coils the swinging bodies swing and strike the sound producing bodies, and the effect is obtained that sounds can be produced with specific rhythms and tempos.

Because the swinging bodies are caused to swing by magnetic interactions between permanent magnets and coils in this way, there are no grating mechanical drive noises and the toy can be made to accurately and faithfully produce sounds with delicate rhythms and tempos. Also, because the swinging bodies are caused to swing only by magnetic interactions between permanent magnets and coils, the effect is obtained that the constitution is simple and the assembly work can be made simple.

Furthermore, when its own switch means is operated each of the toy bodies operates principally and outputs a starting signal and a tapping signal to the other toy bodies, and when the other toy bodies detect an inputting of the starting signal they operate subordinately and swing their swinging bodies and strike their sound producing bodies based on the tapping signal and produce sounds with a specific rhythm and tempo; because one toy body operates principally and the other toy bodies are made to operate subordinately in this way, the effect is obtained that the plurality of toy bodies can be made to operate in precise synchrony and the entertainment of a synchronized performance can be realized.

Also, because no motors or mechanical drive transmission mechanisms are used and the swinging bodies are caused to swing only by magnetic interactions between permanent magnets and coils, the effect is obtained that the constitution is simple and the assembly work can be made simple.

Furthermore, because the toy bodies each produce rhythm sounds by swinging their swinging bodies and striking their sound producing bodies, it looks just like the toy bodies are creating the tune themselves, and a very interesting musical toy can therefore be provided.

According to the sixth means of the invention, because the toy body operating principally outputs to the other toy bodies a starting signal, a tapping signal consisting of a plurality of parts, and an assigning signal which assigns the tapping signal of the parts to respective toy bodies, and when they detect the inputting of the starting signal the other toy bodies operate subordinately and their swinging bodies swing based on the tapping signals of the parts assigned to them from the tapping signal consisting of the plurality of parts, the effect is obtained that it is possible for the rhythms and tempos performed to be varied and the toy can be made to produce sounds with more complex and delicate rhythms and tempos.

Because the swinging bodies are caused to swing just by magnetic interactions between permanent magnets and coils in this way, there are no grating mechanical drive noises and the effect is obtained that the toy can be made to accurately and faithfully produce sounds with delicate rhythms and tempos. Also, the effect is obtained that assembly is easy and the whole toy can be made small.

What is claimed is:

1. A musical toy wherein:

(a) there are provided a toy body, a sound producing body and a control device;

(b) the toy body comprises a first permanent magnet and a swinging body swingably mounted in the vicinity of the first permanent magnet;

(c) the swinging body comprises a tapper for striking the sound producing body and an acting part for magnetically interacting with the first permanent magnet and generating a swinging force;

(d) the acting part comprises a second permanent magnet for swinging the tapper up;

(e) the acting part comprises a coil for swinging down the upswung tapper against the resistance of the second permanent magnet;

(f) the control device comprises rhythm signal generating means for generating a rhythm signal and by supplying this rhythm signal to the coil causes the swinging body to swing according to the rhythm signal; and (g) the sound producing body is disposed in such a position that it is struck by the tapper of the swinging body when the swinging body swings according to the rhythm signal.

2. A musical toy wherein:

(a) there are provided a plurality of toy bodies, a plurality of sound producing bodies disposed in correspondence with a plurality of musical notes, and a control device;

(b) each of the toy bodies has a first permanent magnet and a swinging body swingably mounted in the vicinity of the first permanent magnet;

(c) the swinging bodies of the toy bodies are severally mounted in correspondence with the plurality of musical notes;

(d) each of the swinging bodies comprises a tapper for striking the sound producing body of the corresponding musical note and an acting part for magnetically interacting with the respective first permanent magnet and generating a swinging force;

(e) each of the acting parts comprises a second permanent magnet for swinging the respective tapper up;

(f) each of the acting parts comprises a coil for swinging down the respective upswung tapper against the resistance of the respective second permanent magnet;

(g) the control device comprises melody signal generating means for generating a melody signal consisting of a plurality of musical notes and by supplying this melody signal to the coils causes the swinging bodies to swing according to the melody signal; and (h) the sound producing bodies are disposed in such positions that they are struck by the tappers of the corresponding swinging bodies when the swinging bodies swing according to the melody signal.

3. A musical toy wherein:

(a) there are provided a toy body, a sound producing body and a control device;

(b) a coil is fixed inside the toy body;

(c) an arm is horizontally pivotally mounted on one side of the toy body;

(d) a permanent magnet is mounted on the base portion of the arm;

(e) the permanent magnet is disposed facing the coil;

(f) the arm is caused to horizontally pivot by a magnetic interaction force acting between the permanent magnet and the coil;

(g) the control device comprises rhythm signal generating means for generating a rhythm signal and by supplying this rhythm signal to the coil causes the arm to horizontally pivot according to the rhythm signal;

(h) a tapper is mounted on the end of the arm and the sound producing body is disposed in such a position that it is struck by the tapper when the arm horizontally pivots according to the rhythm signal;

(i) the toy body comprises a magnetic body disposed facing the permanent magnet and the arm is forcibly caused to pivot to an initial position by a magnetic interaction force acting between the magnetic body and the permanent magnet; and (j) the magnetic interaction force acting between the magnetic body and the permanent magnet is smaller than the magnetic interaction force acting between the coil and the permanent magnet.

4. A musical toy wherein:

(a) there are provided a toy body, a sound producing body and a control device;

(b) a coil is fixed inside the toy body;

(c) a first arm is horizontally pivotally mounted on one side of the toy body;

(d) a permanent magnet is mounted on the base portion of the first arm;

(e) the permanent magnet is disposed facing the coil;

(f) the first arm is caused to horizontally pivot by a magnetic interaction force acting between the permanent magnet and the coil;

(g) a second arm is horizontally pivotally mounted on the other side of the toy body;

(h) the second arm is linked to the base portion of the first arm and is caused to horizontally pivot in conjunction with the first arm;

(i) the control device comprises rhythm signal generating means for generating a rhythm signal and by supplying this rhythm signal to the coil causes the first and second arms to horizontally pivot according to the rhythm signal;

(j) a sound producing body is mounted on the end of each arm horizontally pivoting according to the rhythm signal;

(k) the toy body comprises a magnetic body disposed facing the permanent magnet and both of the arms are forcibly caused to pivot to an initial position by a magnetic interaction force acting between the magnetic body and the permanent magnet; and (l) the magnetic interaction force acting between the magnetic body and the permanent magnet is smaller than the magnetic interaction force acting between the coil and the permanent magnet.

5. A musical toy wherein:

(a) there are provided a plurality of electrically or optically connected toy bodies;

(b) each of the toy bodies comprises a permanent magnet and a swinging body swingably mounted in the vicinity of the permanent magnet, and the swinging body is provided with a coil for magnetically interacting with the permanent magnet and causing the swinging body to swing;

(c) each of the toy bodies comprises a sound producing body disposed in such a position that it is struck by the swinging body;

(d) each of the toy bodies comprises switch means and principal operating means for principally operating when the switch means is operated;

(e) each principal operating means comprises starting signal outputting means for outputting a starting signal and tapping signal outputting means for outputting a tapping signal;

(f) each of the toy bodies comprises subordinate operating means for subordinately operating when detecting an inputting of the starting signal; and (g) each subordinate operating means comprises driving signal supplying means for when detecting an inputting of the tapping signal supplying a driving signal to the respective coil based on the tapping signal.

6. A musical toy wherein:

(a) there are provided a plurality of electrically or optically connected toy bodies;

(b) each of the toy bodies comprises a permanent magnet and a swinging body swingably mounted in the vicinity of the permanent magnet, and the swinging body is provided with a coil for magnetically interacting with the permanent magnet and causing the swinging body to swing;

(c) each of the toy bodies comprises a sound producing body disposed in such a position that it is struck by the swinging body;

(d) each of the toy bodies comprises switch means and principal operating means for principally operating when the switch means is operated;

(e) each principal operating means comprises starting signal outputting means for outputting a starting signal, tapping signal outputting means for outputting a tapping signal consisting of a plurality of parts, and assignment signal outputting means for outputting an assignment signal assigning tapping signals of the individual parts to respective toy bodies;

(f) each of the toy bodies comprises subordinate operating means for subordinately operating when detecting an inputting of the starting signal; and (g) each subordinate operating means comprises driving signal supplying means for when detecting an inputting of the tapping signal consisting of a plurality of parts detecting the tapping signal of the part assigned to that toy body by the assignment signal and supplying a driving signal to the respective coil based on the tapping signal of this assigned part.

7. A musical toy, comprising:

(a) a toy body, a sound producing body, and a control device;

(b) the toy body including a first permanent magnet and a swinging body mounted thereon in the vicinity of the first permanent magnet;

(c) the swinging body including a tapper for striking the sound producing body, a second permanent magnet and a coil;

(d) the second permanent magnet for magnetically interacting with the first permanent magnet to generate a first swinging force for swinging the swinging body in a first direction;

(e) the coil upon being energized interacting with the first permanent magnet to generate a second swinging force overcoming the first swinging force and swinging the swinging body in a second direction generally opposite the first direction;

(f) the sound producing body disposed in such a position that it is struck by the tapper when the swinging body is swung in the second direction; and (g) the control device including rhythm signal generating means for generating a rhythm signal supplied to the coil to energize the coil to generate the second swinging force according to the rhythm signal.

8. A musical toy, comprising:

(a) a toy body and a control device;

(b) a coil mounted inside the toy body;

(c) a frame mounted movably in the toy body for movement in first and second directions;

(d) a pair of arms mounted pivotally for pivoting movement outwardly away from each other upon the frame being moved in the first direction and for pivoting movement toward each other upon the frame being moved in the second direction, one of said arms including a base portion to which the frame is fixed and the other of said arms being linked to said the portion of the first arm for pivoting in conjunction with the first arm;

(e) permanent magnet means mounted on the frame;

(f) the toy body including a magnetic body disposed facing the permanent magnet means and magnetic interaction between the magnetic body and the permanent magnet means producing a first magnetic interaction force moving the frame in the first direction toward the magnetic body causing the arms to pivot outwardly away from each other;

(g) a pair of sound producing bodies mounted at the ends of the arms;

(h) the control device including rhythm signal generating means for generating a rhythm signal supplied to the coil and magnetic interaction between the coil and the permanent magnet means producing a second magnetic interaction force moving the frame in the second direction towards the coil causing the arms to pivot toward each other and to cause the sound producing bodies to strike each other producing sound in correspondence to the rhythm signal.

* * * * *